US009415593B2

(12) United States Patent
Yokoyama et al.

(10) Patent No.: US 9,415,593 B2
(45) **Date of Patent: *Aug. 16, 2016**

(54) INK JET HEAD AND MANUFACTURING METHOD OF THE SAME

(71) Applicant: TOSHIBA TEC KABUSHIKI KAISHA, Tokyo (JP)

(72) Inventors: Shuhei Yokoyama, Shizuoka (JP); Ryutaro Kusunoki, Shizuoka (JP); Chiaki Tanuma, Tokyo (JP); Ryuichi Arai, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,644

(22) Filed: Jul. 2, 2015

(65) Prior Publication Data

US 2015/0298458 A1 Oct. 22, 2015

Related U.S. Application Data

(63) Continuation of application No. 13/864,535, filed on Apr. 17, 2013, now Pat. No. 9,150,008.

(30) Foreign Application Priority Data

Apr. 17, 2012 (JP) ..... 2012-093854

(51) Int. Cl.

| | |
|---|---|
| ***B41J 2/015*** | (2006.01) |
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/045* (2013.01); *B41J 2/161* (2013.01); *B41J 2/1623* (2013.01);

(Continued)

(58) Field of Classification Search

None

See application file for complete search history.

(56) References Cited

U.S. PATENT DOCUMENTS 5,002,812 A * 3/1991 Umehara ..... G11B 7/244 346/135.1

7,378,030 B2 5/2008 Truninger et al.

(Continued)

FOREIGN PATENT DOCUMENTS

JP H3-065350 A 3/1991

JP H10-058672 A 3/1998

(Continued)

OTHER PUBLICATIONS

Japanese Office Action with English translation, Patent Application No. JP 2012-093854, dated Feb. 26, 2014.

*Primary Examiner* — Erica Lin

(74) *Attorney, Agent, or Firm* — Patterson & Sheridan, LLP

(57) ABSTRACT

An ink jet head includes: a vibration plates having a plurality of openings of a first diameter; ink pressure chambers, each arranged on one surface of the corresponding vibration plate; first electrodes, each formed on the other surface of the vibration plate; a plurality of piezoelectric layers, each portion of which is formed on a first electrode such that it surrounds the opening and that, when a driving voltage is applied, deforms the vibration plate to expand or contract the ink pressure chamber; second electrodes formed on each piezoelectric layer; a protective layer which is at least formed on the vibration plate and the second electrode and has a nozzle for ejecting the ink having a diameter smaller than the first diameter extending therethrough and through the opening; and an ink-feeding mechanism that feeds the ink into the ink pressure chambers.

12 Claims, 19 Drawing Sheets

(52) U.S. Cl.
CPC ..... *B41J 2/1628* (2013.01); *B41J 2/1629* (2013.01); *B41J 2/1631* (2013.01); *B41J 2/1632* (2013.01); *B41J 2/1642* (2013.01); *B41J 2/1643* (2013.01); *B41J 2/1645* (2013.01); *B41J 2/1646* (2013.01); *B41J 2002/1437* (2013.01); *Y10T 29/42* (2015.01)

(56) References Cited

U.S. PATENT DOCUMENTS

| | | | | |
|---|---|---|---|---|
| 8,801,147 | B2 | 8/2014 | Kusunoki et al. | |
| 2008/0042288 | A1* | 2/2008 | Yamazaki | H01L 21/288 257/759 |
| 2011/0037813 | A1 | 2/2011 | Nakatani | |
| 2011/0069103 | A1* | 3/2011 | Makimoto | B41J 11/0005 347/16 |
| 2012/0056947 | A1* | 3/2012 | Tanuma | B41J 2/14233 347/71 |
| 2013/0063522 | A1 | 3/2013 | Arai et al. | |
| 2013/0070027 | A1 | 3/2013 | Arai et al. | |
| 2013/0235123 | A1 | 9/2013 | Yokoyama et al. | |

FOREIGN PATENT DOCUMENTS

| | | | |
|---|---|---|---|
| JP | 2000-190490 | A | 7/2000 |
| JP | 2000-289201 | A | 10/2000 |
| JP | 2005-088441 | A | 4/2005 |
| JP | 2011-056939 | A | 3/2011 |

* cited by examiner

INK JET HEAD AND MANUFACTURING METHOD OF THE SAME

CROSS-REFERENCE TO RELATED APPLICATION

This application is based on a continuation of U.S. patent application Ser. No. 13/864,535, filed on Apr. 17, 2013, which is based upon and claims the benefit of priority from Japanese Patent Application No. 2012-093854, filed Apr. 17, 2012. Each of the aforementioned patent applications is incorporated by reference herein in its entirety.

FIELD

Embodiments described herein relate to an ink jet head for ejecting ink from nozzles to form an image and an ink jet head manufacturing method.

BACKGROUND

In the related art, there is the on-demand type of inkjet printing system in which ink droplets are ejected from nozzles in an image pattern based upon an image signal, to form the image on a print media such as a paper sheet. The on-demand type of inkjet recording systems mainly consists of two subtypes: the heating element type and the piezoelectric element-type. For the configuration of the heating element type, as power is fed to a heating element in an ink-flow channel, a gas bubble is generated in the ink, and the gas bubble pushes the desired quantity of ink out from the nozzle. For the piezoelectric element-type, the piezoelectric element is energized to create waves in the ink to eject the desired quantity of the ink stored in the ink chamber out of the nozzle.

A piezoelectric element (piezo-element) is an element that converts a voltage to a force. When an electric field is applied to the piezoelectric element, stretching or shear deformation of the element takes place, causing a change in the volume of the ink chamber against which it is placed. A typical piezoelectric element is made of lead titanate zirconate.

In the configuration of an ink jet head using a piezoelectric element, a nozzle substrate is formed from a piezoelectric material. For this ink jet head, electrodes are formed on the two surfaces of the nozzle substrate to either side of the nozzle. The ink enters an area between the nozzle substrate and a substrate that supports the nozzle substrate. The ink forms a meniscus inside the nozzle and is held inside the nozzle. When a driving waveform is applied to the electrodes of the nozzle substrate to vibrate the piezoelectric element, the piezoelectric element around the nozzle vibrates. As the piezoelectric element vibrates, an ultrasonic wave vibration is generated inside the nozzle so that the ink in the meniscus is ejected. As the piezoelectric element on the nozzle substrate is energized to vibrate, vibration energy is concentrated from a peripheral edge portion of an ink droplet-ejection opening towards a center thereof so that the ink droplets are ejected from an ink surface in a perpendicular direction.

It is difficult to form plural nozzles with high precision and at low cost with respect to the piezoelectric element.

DETAILED DESCRIPTION

In general, a detailed description according to one embodiment of the present invention will be explained with reference to the figures.

The ink jet head in an embodiment of the present invention has the following components: vibration plates, each having an opening with a first diameter; ink pressure chambers, each communicating with the opening and arranged on one surface of the corresponding vibration plate; first electrodes, each formed on the other surface of the vibration plate; a piezoelectric layer, each portion of which is formed on the first electrode on a region that surrounds the opening, which, when a driving voltage is applied, deforms the vibration plate to expand or contract the ink pressure chamber; second electrodes, each formed on the piezoelectric layer; a protective layer, each portion of which is at least formed on the vibration plate, and the second electrode and has a nozzle for ejecting the ink with a diameter smaller than the first diameter arranged in the opening; and an ink-feeding mechanism that feeds the ink into the ink pressure chambers.

First Embodiment

Figure 1:
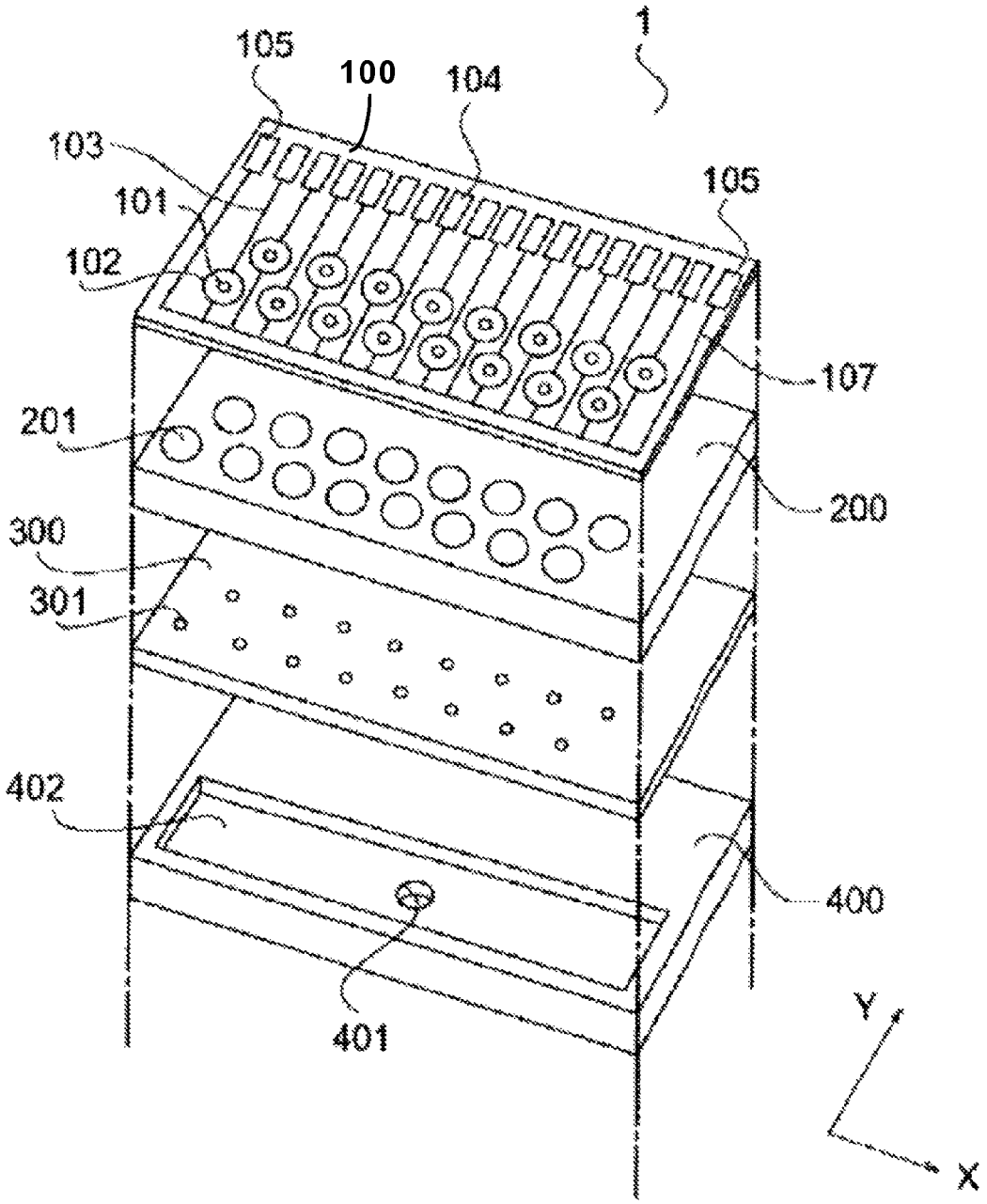
FIG. 1 is an exploded perspective view of an ink jet head in a first embodiment.

FIG. 1 is an exploded perspective view of an ink jet head in a first embodiment.

As shown in FIG. 1, an ink jet head 1 includes a nozzle plate 100, an ink pressure chamber structural body 200, a separation plate 300, and an ink-feeding path structural body 400.

The nozzle plate 100 includes plural nozzles 101 (ink-ejecting holes) for ink injection that extend through the thickness of the nozzle plate 100 in a direction substantially perpendicular to the planar face thereof.

The ink pressure chamber structural body 200 includes a plurality of ink pressure chambers 201 each of which corresponds to one of the plural nozzles 101. Each of the ink pressure chambers 201 overlies and is in fluid communication with a corresponding nozzle 101.

On the separation plate 300, there are provided ink throttles 301 (ink-feeding openings to the ink pressure chambers) which individually connect to one of the ink pressure chambers 201 formed in the ink pressure chamber structural body 200.

An ink pressure chamber 201 and an ink throttle 301 are each arranged to correspond to one of the plural nozzles 101. The plural ink pressure chambers 201 are connected via the ink throttles 301 to an ink-feeding path 402.

The ink pressure chambers 201 hold the ink for forming the image. Due to deformation of the nozzle plate 100, the pressure of the ink in each of the ink pressure chambers 201 is changed, and the ink is ejected from each of the nozzles 101. In this case, the separation plate 300 has the function to enclose the ink, or to maintain the pressure generated in the ink pressure chambers 201 to prevent the pressure from escaping to the ink-feeding path 402. For this purpose, the diameter of the ink throttles 301 is ¼ of the diameter of the ink pressure chambers 201 or smaller.

The ink-feeding path 402 is provided within the ink-feeding path structural body 400. In the ink-feeding path structural body 400, there is an ink-feeding port 401 for feeding the ink from outside of the ink jet head. The ink-feeding path 402 is a reservoir or manifold that is positioned and sized to be in fluid communication with all of the plural ink pressure chambers 201 so that the ink can be simultaneously fed to all of the ink pressure chambers 201.

In the embodiment, the ink pressure chamber structural body 200 is formed from a 725-μm-thick silicon wafer. Each of the ink pressure chambers 201 has a cylindrical shape with diameter of 240 μm. There is the nozzle 101 arranged at the center of the diameter of each of the right cylindrical ink pressure chambers 201.

The separation plate 300 is a 200-μm-thick stainless steel plate. In the embodiment, the ink throttles 301 each have a diameter of 60 μm. The ink throttles 301 are formed to be substantially identical to suppress differences in the shape of the ink throttles 301 so that the fluid resistance of the ink-flow channels to the ink pressure chambers 201 are almost the same. Incidentally, the ink throttles 301 can be removed if the diameter or depth of the ink pressure chamber body 201 is adequately designed. In such a case, even if the ink separation plate 300 having the ink throttles 301 is not built in the inkjet head 1, ink drops still can be discharged from the inkjet head 1.

In the embodiment, the ink-feeding path structural body 400 is a 4-mm-thick stainless steel plate. The ink-feeding path 402 has a depth of 2 mm from the surface of the stainless steel plate. An ink-feeding port 401 is provided at, or nearly at, the center of the ink-feeding path 402. The ink-feeding port 401 is formed so that the fluid resistance of the ink flow channels to the ink pressure chambers 201 is almost the same.

Figure 2:
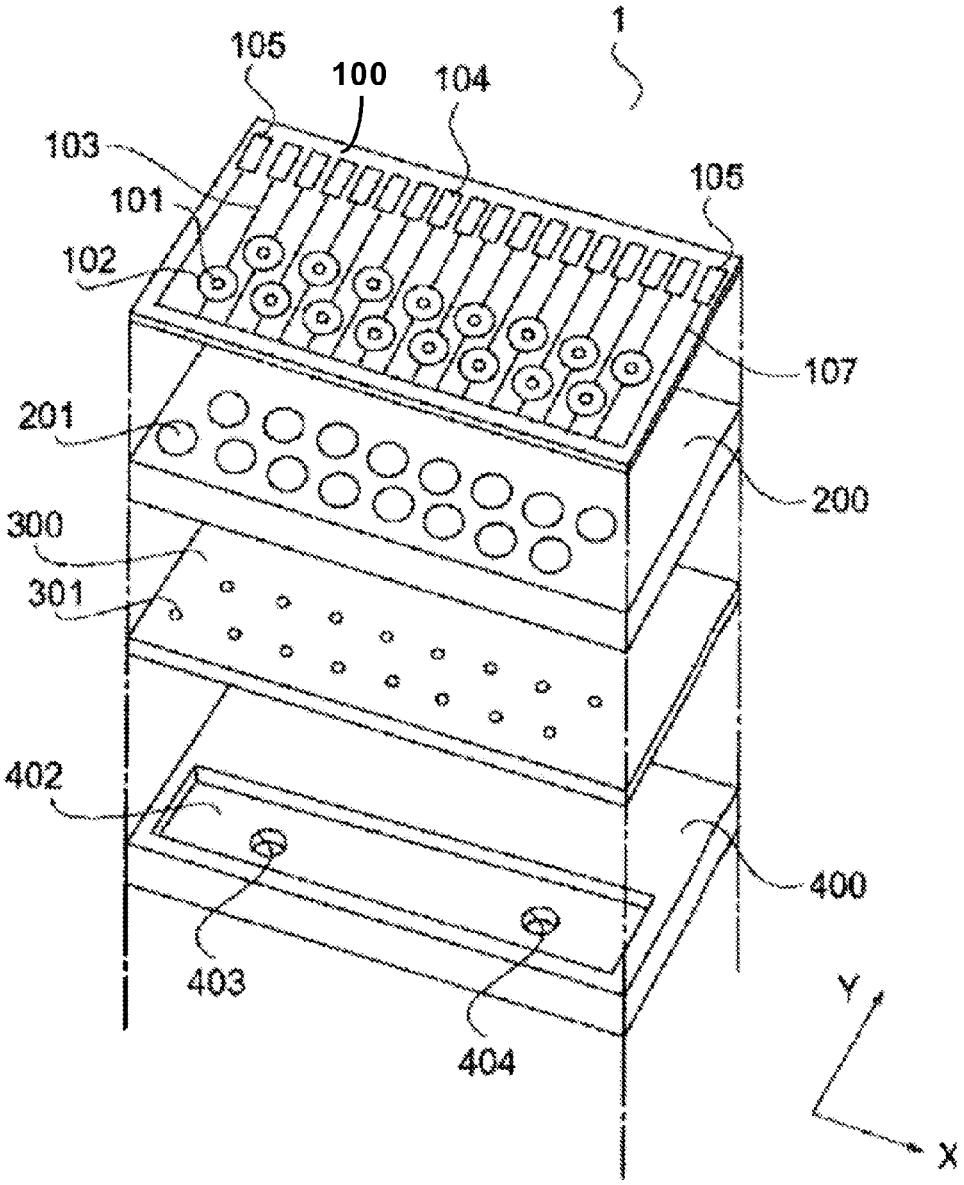
FIG. 2 is an exploded perspective view of the ink jet head of the first embodiment as another example different from the view shown in FIG. 1.

The configuration shown in FIG. 2 differs from the configuration shown in FIG. 1 in that a circulating ink-feeding port 403 and a circulating ink-exhausting port 404 are arranged near the two ends of the ink-feeding path 402, so that the ink can be circulated through the ink-feeding path 402. By circulating the ink, it is possible to keep the ink temperature in the ink-feeding path 402 at a constant value. Consequently, compared to the ink jet head shown in FIG. 1, this configuration can suppress the temperature rising in the ink jet head caused by the heat generated by the deformation of the nozzle plate 100.

The nozzle plate 100 has a monolithic structure formed in the layer-formation process to be explained later on the ink pressure chamber structural body 200.

The ink pressure chamber structural body 200, the separation plate 300, and the ink-feeding path structural body 400 are anchored together using an epoxy resin adhesive so that the nozzles 101 and the ink pressure chambers 201 maintain a prescribed positional relationship among themselves.

The ink pressure chamber structural body 200 is formed from a silicon wafer, and the separation plate 300 and ink-feeding path structural body 400 are made of stainless steel. However, the materials of these structural bodies 200, 300, and 400 are not limited to silicon wafer and stainless steel. The structural bodies 200, 300, and 400 may also be made of other materials as long as there is no influence on the generation of the ink-ejecting pressure in consideration of the difference in the expansion coefficient from the nozzle plate 100. Examples of the ceramic materials that may be used in this case include alumina ceramics, zirconia, silicon carbide, silicon nitride, barium titanate, and other nitrides and oxides. Examples of the resin materials that may be used in this case include ABS (acrylonitrile butadiene styrene), polyacetal, polyamide, polycarbonate, polyether sulfone, and other plastic materials. Also, metal materials (alloys) may be used. Typical examples include aluminum, titanium, and other materials.

Figure 3:
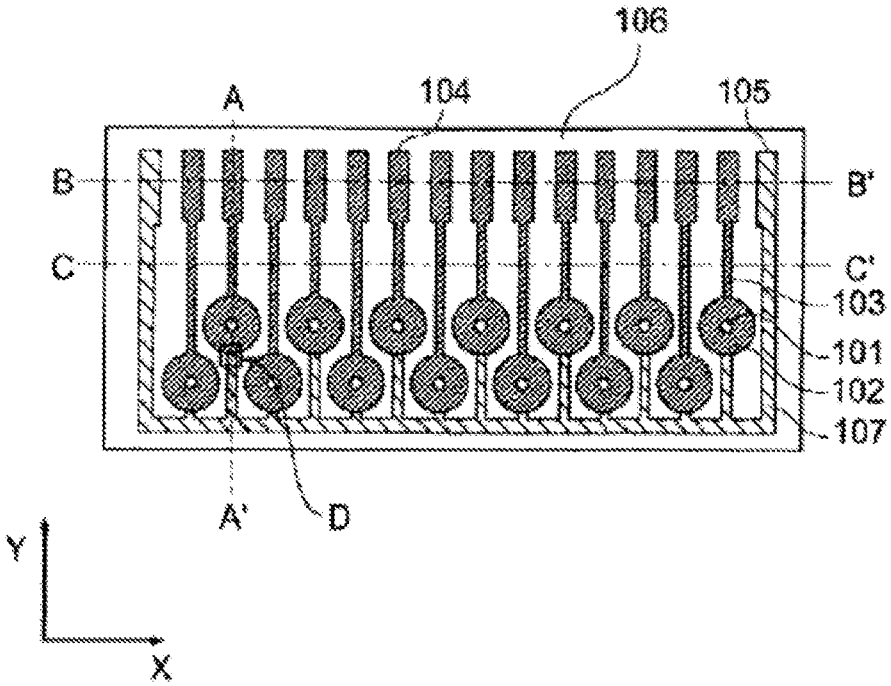
FIG. 3 is a plan view illustrating the ink jet head in the first embodiment.

In the following, the configuration of the nozzle plate 100 will be explained with reference to FIG. 3. FIG. 3 is a plan view of the nozzle plate 100 as viewed from the ink-ejecting side.

The nozzle plate 100 has the nozzles 101 that eject the ink and actuators 102 that generate the pressure for ejecting the ink from the nozzles 101. The nozzle plate 100 has wiring electrodes 103 and a shared electrode 107 for transmitting a signal for driving the corresponding actuators 102. Here, the nozzle plate 100 has wiring electrode terminal sections 104, which are a portion of the wiring electrodes 103 and which receive the signal for driving the inkjet head 1 from outside of the inkjet head 1, and common or shared electrode terminal sections 105, which, similarly, are a portion of the shared electrode 107 and receive the signal for driving the ink jet head 1.

The actuators 102, the wiring electrodes 103, the wiring electrode terminal sections 104, the shared electrode 107, and the shared electrode terminal sections 105 are formed on a vibration plate 106.

The nozzles 101 are formed to extend through the nozzle plate 100. For each of the ink pressure chambers 201, the center of the circular cross-section thereof is aligned with the center of the corresponding nozzle 101. The ink is fed from each ink pressure chamber 201 into the corresponding nozzle 101. Due to the operation of the actuator 102 corresponding to the nozzle 101, the vibration plate 106 deforms, and, due to the variation in the pressure generated in the ink pressure chamber 201, the ink fed into the nozzle 101 is ejected. All of the nozzles 101 work in the same way.

In the embodiment, the nozzles 101 have a right cylindrical shape and have a diameter of 20 μm.

The actuators 102 are each formed from a piezoelectric layer. The actuators 102 each work due to the piezoelectric layer and the 2 electrodes (the wiring electrode 103 and the shared electrode 107) that have the piezoelectric layer inserted between them. When the piezoelectric layer is formed, polarization takes place in the direction perpendicular to the surface of the piezoelectric layer. When an electric field in the same direction as the direction of the polarization is applied via the electrodes on the piezoelectric layer, the actuators 102 stretch or contract in the direction orthogonal to the electric field direction. This stretching/contraction is exploited to cause the vibration plate 106 to deform in the direction perpendicular to the nozzle plate 100 to change the volume of the ink pressure chamber 201 so that a change takes place in the pressure on the ink in the ink pressure chamber 201. The piezoelectric layer has a circular shape. The piezoelectric layer is formed concentric to the ejection-side opening of the nozzle 101. In the embodiment the diameter of the circular piezoelectric layer is 170 μm. That is, the piezoelectric layer surrounds the ejection-side opening of the nozzle 101.

In the following, an operation of a piezoelectric layer 108 that is a part of the actuators 102 will be described. Here, the piezoelectric layer 108 contracts or stretches in the direction orthogonal to the layer thickness (in the in-plane direction). As the piezoelectric layer contracts, the vibration plate 106 coupled with the piezoelectric layer 108 bends in the direction which expands the ink pressure chamber 201. The bending to expand the ink pressure chamber 201 leads to the generation of a negative pressure on the ink stored in the ink pressure chamber 201. Due to the generated negative pressure, ink is fed into the chamber 201 from the ink-feeding path structural body 400. In contrast, as the piezoelectric layer 108 stretches, the vibration plate 106 coupled to the piezoelectric layer 108 is bent in the direction toward the ink pressure chamber. Due to the bending of the vibration plate 106 in the direction toward the ink pressure chamber 201, a positive pressure is generated on the ink stored in the ink pressure chamber 201. Due to the generated positive pressure, an ink droplet is ejected from the nozzle 101 arranged on the vibration plate 106. When the ink pressure chamber 201 expands or contracts, the portion of the vibration plate near the nozzle deforms in the direction to eject the ink due to the displacement of the piezoelectric layer. In other words, the actuator that ejects the ink functions by bending.

In the embodiment, the actuator 102 having the nozzle 101 arranged at its center is made of a piezoelectric layer with a diameter of 170 μm. To arrange the nozzles 101 at a high density, the actuators 102 are arranged in a zigzag configuration (shifted from each other in lines). As shown in FIG. 3, plural nozzles 101 are arranged in a linear configuration in the X-axis direction. In the Y-axis direction, there are 2 linear-shaped nozzle columns. In the embodiment, the distance between the centers of the nozzles 101 adjacent to each other in the X-axis direction is 340 μm, and in the direction of the Y-axis, the interval between the columns of the nozzles 101 is 240 μm. With such a configuration, the wiring electrodes 103 pass between the 2 actuators 102 in the X-axis direction.

As the material of the piezoelectric layer, PZT (lead zirconate titanate) is used. Other materials that may also be used there include PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, AlN, etc.

The piezoelectric layer is formed using the RF magnetron sputtering method at a substrate temperature of 350° C. In the embodiment, the layer thickness is 1 μm. After formation of the piezoelectric layer, to imbue the piezoelectric property into the piezoelectric layer, the layer is subjected to heat treatment at 500° C. for 3 hours. As a result, it is possible to achieve excellent piezoelectric performance. Other methods for manufacturing the piezoelectric layer include the CVD (chemical vapor deposition) method, sol-gel method, AD (aerosol deposition) method, hydrothermal synthesis method, etc. The thickness of the piezoelectric layer is determined in consideration of the piezoelectric characteristics, the insulation breakdown voltage, etc. The thickness of the piezoelectric layer is generally in the range from 0.1 μm to 5 μm.

The plural wiring electrodes 103 are one of the two electrodes connected to the piezoelectric layer of each ones of the actuators 102. The plural wiring electrodes 103 are each arranged on the ejecting side of the nozzle plate 100 with respect to the piezoelectric layer. Each of the wiring electrodes 103 is individually connected to the piezoelectric layer of the corresponding actuator 102. Each of the wiring electrodes 103 works as an individual electrode to independently operate the piezoelectric layer of a specific nozzle. Each of the wiring electrodes 103 includes an electrode section in a circular shape having a size larger than that of the circular piezoelectric layer, wiring section and a wiring electrode terminal section 104. At the center of each circular electrode section, the nozzle 101 is formed and extends through the ink ejecting structural body and thus no wiring electrode is formed there.

The plural wiring electrodes 103 are made of a Pt (platinum) thin layer. In the embodiment the thin layer is formed by a sputtering method, and the layer thickness is 0.5 μm. Otherelectrode materials for forming the wiring electrodes 103 include Ni (nickel), Cu (copper), Al (aluminum), Ti (titanium), W (tantalum), Mo (molybdenum), Au (gold), etc. Also, other layer-forming methods may be used, such as a vapor deposition method and a gold plating method. The preferable layer thickness of the wiring electrodes 103 is in the range from 0.01 μm to 1 μm.

The shared or common electrode 107 is the other one of the two electrodes connected to the piezoelectric layer, and is formed on the ink pressure chamber 201 side with respect to the piezoelectric layer. The shared or common electrode 107 is connected to the respective piezoelectric layer portions and shared by them, and works as a common electrode. The shared or common electrode 107 includes circular electrode portions with a diameter smaller than that of the circular piezoelectric layer, wiring sections extending from the circular electrodes in the direction opposite to the individual electrode wiring sections from the actuators 102 and joined together at one side (along the Y axis direction) of the nozzle plate 100 in a common bus, and shared electrode terminal sections 105 extending at either end of the common bus in the y direction to the other side (in the Y direction) of the nozzle plate 100. At the center of the circular electrode portion, the nozzle 101 is formed. For this purpose, just as for the wiring electrode layer, the shared electrode layer extends concentrically around the nozzle 101.

The shared electrode 107 is made of a Pt (platinum)/Ti (titanium) thin layer. In the embodiment, the thin layer is formed using the sputtering method, and the layer thickness is 0.5 μm. Other materials that also can be used to form the shared electrode 107 include Ni, Cu, Al, Ti, W, Mo, Au, etc. Other layer-forming methods, such as vapor deposition and gold plating, may also be used. The preferable layer thickness of the shared electrode 107 is in the range from 0.01 μm to 1 μm.

The wiring electrode terminal sections 104 and the shared electrode terminal sections 105 are arranged to receive a signal for driving the actuators 102 from the external driving circuit. The wiring electrodes 103 and the shared electrode 107 are wired to the actuators 102, and the wiring width in this application example is about 80 μm.

The shared electrode terminal sections 105 are on the two ands (in the X direction) of each wiring electrode terminal section 104. Because the interval between the wiring electrode terminal sections 104 is 170 μm, the wiring width of the wiring electrode terminal section 104 in the X-axis direction can be made wider than the wiring width of the wiring electrode 103. Consequently, connection to the external driving circuit becomes easier. The wiring electrodes 103 work as individual electrodes for driving the actuators 102.

In the following, with reference to the cross-section taken across the A-A' axis in FIG. 3, the manufacturing method of the ink jet head will be explained.

FIGS. 4 to 15 illustrate a state of operational steps in a processing operation of the ink jet head. The thin layers for forming the ink jet head may also be formed by spin coating.

Figure 8:
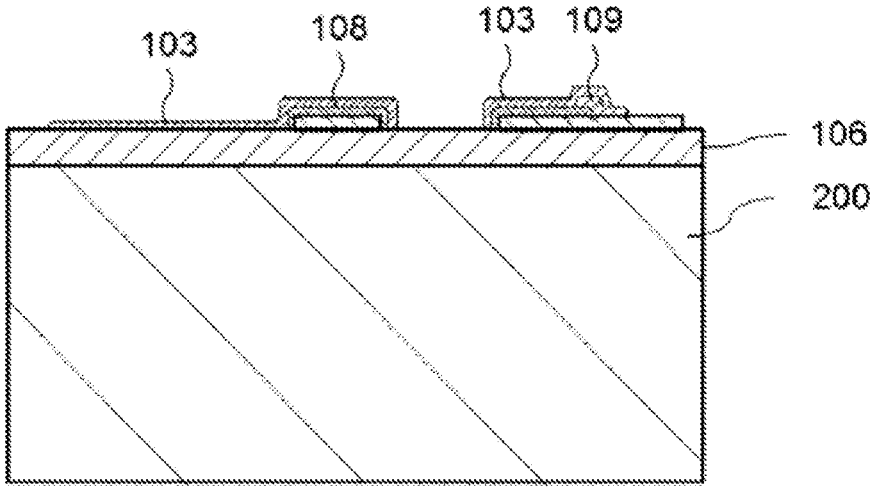
FIG. 8 is a diagram illustrating a wiring electrode formed on the shared electrode, the piezoelectric layer and the vibration plate in an operational step after the step shown in FIG. 7.
Figure 9:
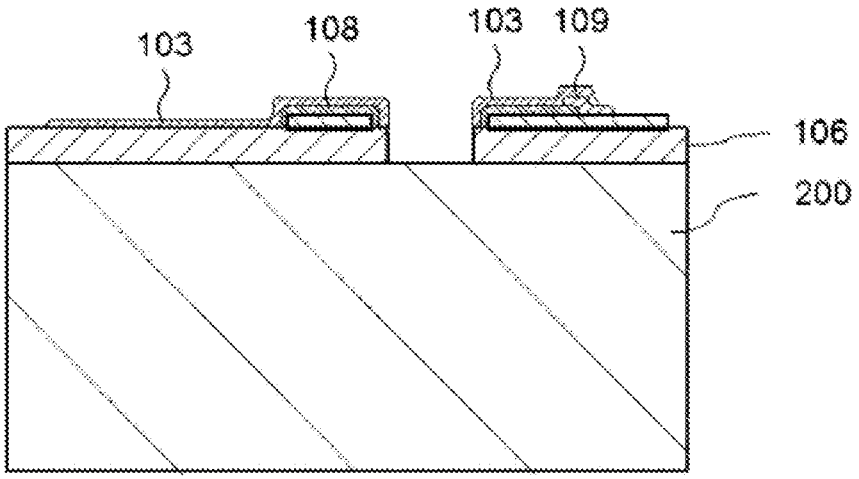
FIG. 9 is a diagram illustrating a state in which a portion of the vibration plate is pierced through in an operational step after the step shown in FIG. 8.
Figure 10:
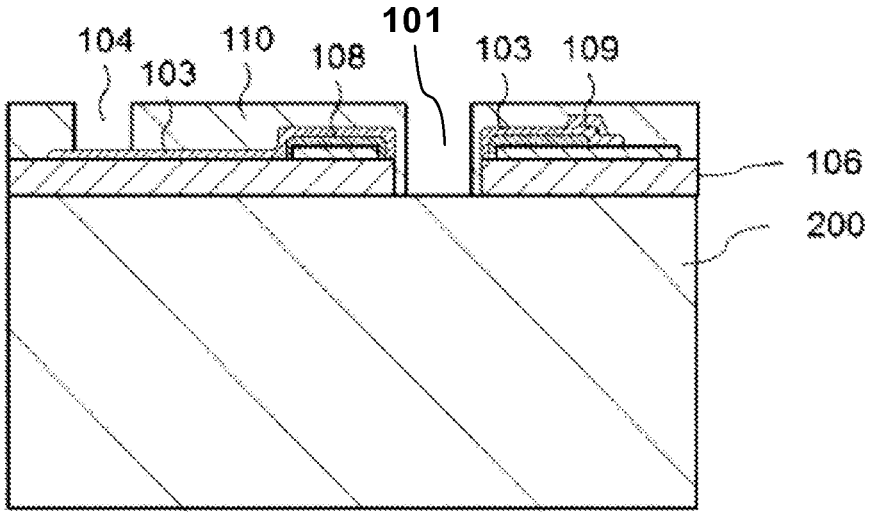
FIG. 10 is a diagram illustrating a protective layer formed on the vibration plate, the wiring electrode, the shared electrode, and the insulating layer in an operational step after the step shown in FIG. 9.

FIGS. 4 to 10 illustrate the individual layers of electrodes 103, 107 and piezoelectric 108 used to form the actuators, the actuator 102 final structure shown having the nozzle formed therethrough in FIG. 10. Generally, the actuator 102 is formed by depositing and patterning, on an underlying dielectric layer 106 formed on structural body 200, the common electrode 107 material, the piezoelectric material 108 and the second electrode material 103 thereover, covering the patterned materials with a polyimide film, and then pattern etching the polyimide film to provide the nozzle through the center of the stack.

Figure 4:
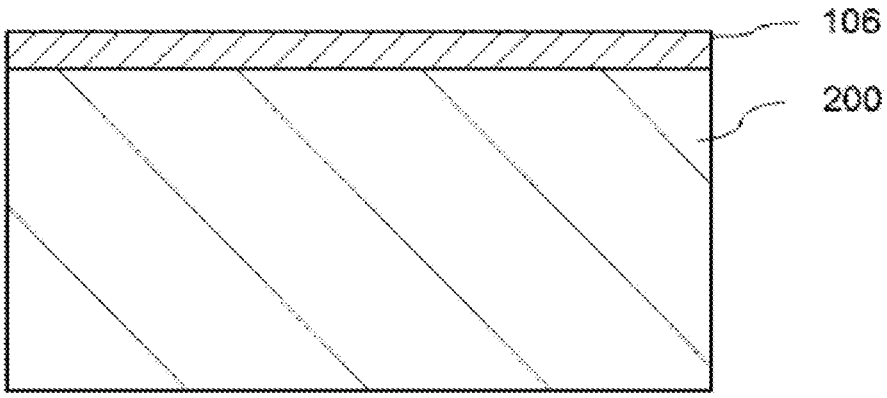
FIG. 4 is a cross-sectional view illustrating the ink jet head shown in FIG. 3 as seen from the left hand side to the right hand side with respect to the A-A' axis.

FIG. 4 is a diagram illustrating the configuration in which the layer of the vibration plate 106 is formed on the ink pressure chamber structural body 200. To form the nozzle plate 100, a silicon wafer polished to mirror surface quality is used as the ink pressure chamber structural body 200. In the process of forming the nozzle plate 100, heating and thin layer formation are carried out repeatedly. Consequently, a silicon wafer with a high heat resistance is used. The silicon wafer is processed to be smoothed to a thickness between 525 μm and 775 μm according to the SEMI (Semiconductor Equipment and Materials International). Instead of the silicon wafer, one may also use heat resistant ceramics, quartz, and various types of metal substrates.

As the vibration plate 106, an $SiO_2$ (silicon oxide) layer formed using the CVD method is used. In the embodiment, a layer with a thickness of 2 μm is formed over the entire surface of the ink pressure chamber structural body 200. In lieu of the CVD method, a thermal oxidation method in which heating a silicon wafer in oxygen environment makes a surface of the wafer change to a SiO2 film can be usable in order to form the vibration plate 106.

The layer thickness of the vibration plate 106 is preferably in the range from 1 to 50 μm. Instead of $SiO_2$, one may also use SiN (silicon nitride), $Al_2O_3$ (aluminum oxide), $HfO_2$ (hafnium oxide), or DLC (diamond-like carbon). The material of the vibration plate 106 is also selected in consideration of a heat resistance, an insulating property (in consideration of the influence of ink denaturing due to driving the actuators 102 when an ink with a high electroconductivity is used), a thermal expansion coefficient, a smoothness, and a wettability with respect to the ink.

Figure 5:
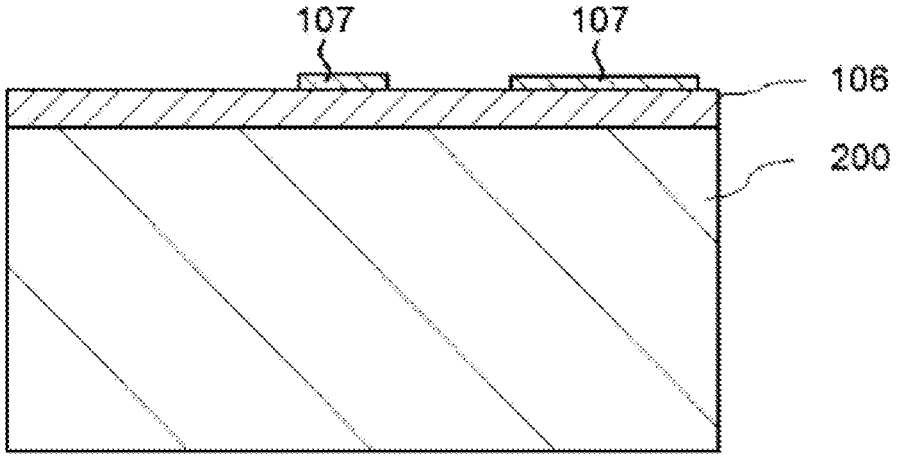
FIG. 5 is a diagram illustrating a shared electrode formed as a layer on a vibration plate in an operational step after the step shown in FIG. 4.

FIG. 5 is a diagram illustrating the formation of the shared electrode 107 on the vibration plate 106. Here, the electrode material is Pt/Ti. The Ti and Pt are sequentially formed using the sputtering method. The layer thickness of the Ti is 0.45 μm, and the layer thickness of the Pt is 0.05 μm.

After formation of the electrode layer, the electrode layer is patterned to form the shared electrode 107 in a shape corresponding to the actuators 102, the wiring section, and the shared electrode terminal sections 105. Here, the patterning operation is carried out by forming an etching mask on the electrode layer and then removing the electrode material by etching, except for the portion covered by the etching mask. The etching mask is formed by coating a photosensitive resist onto the electrode layer followed by pre-baking, and then a mask formed in the desired pattern is used for the sequential exposure, development, and treatment operational step, followed by post-baking.

The portion of the shared electrode 107 corresponding to the piezoelectric layer 108 has a circular pattern with an outer diameter, in the embodiment, of 166 μm, which is smaller than the outer diameter of the piezoelectric layer. Since the nozzle 101 is formed at the center of the circular shared electrode 107, a circular portion free of the electrode film having a diameter of 34 μm is formed concentric to the center of the circular shared electrode 107. As a result, the vibration plate 106 is exposed in the portion thereof outside of the circular-shaped section of the shared electrode 107 and the wiring section.

Figure 6:
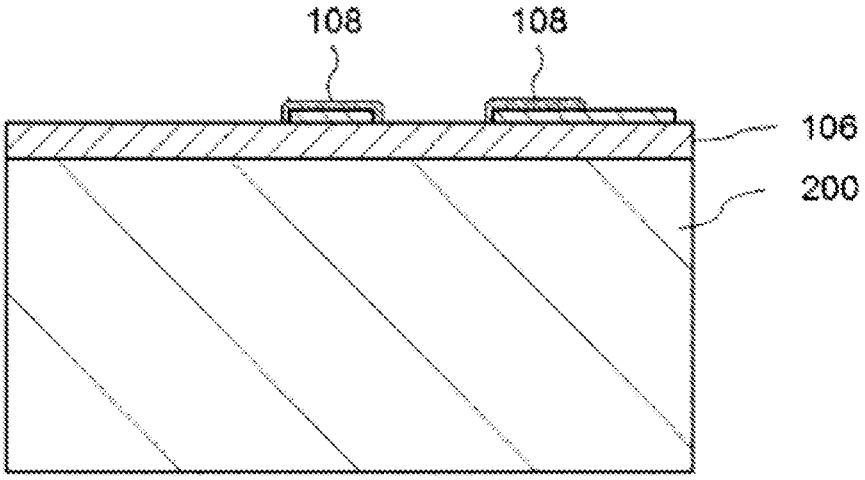
FIG. 6 is a diagram illustrating a piezoelectric layer formed on the shared electrode in an operational step after the step shown in FIG. 5.

FIG. 6 is a diagram illustrating the piezoelectric layer 108 formed on the shared electrode 107. The piezoelectric layer 108 is formed on the shared electrode 107 and the vibration plate 106. The piezoelectric layer 108 is made of PZT. The piezoelectric layer 108 with a thickness, in the embodiment, of 1 μm is formed using the sputtering method at a substrate temperature of 350° C. To imbue the PZT thin layer with piezoelectric properties, heat treatment is carried out at 500° C. for 3 hours. As the PZT thin layer is formed, polarization takes place along the layer in the orthogonal direction from the shared electrode 107.

Patterning of the piezoelectric layer 108 is carried out by etching. After a photosensitive resist is coated onto the piezoelectric layer 108, pre-baking is carried out. A mask is formed in a desired pattern patterning by exposure, development and fixing, followed by post-baking to form an etching mask of the photosensitive resist. The etching mask is used in the etching operation to form the piezoelectric layer 108 in a desired pattern.

The pattern of the piezoelectric layer 108 has a circular shape with an outer diameter, in the embodiment, of 170 μm. In the circular pattern, in order to form the nozzle 101 at the center of the circular pattern, an inner circular portion, free of the piezoelectric layer, and having a diameter of 30 μm, is formed concentric to the center of the piezoelectric layer 108. The vibration plate 106 is exposed inwardly of the 30 μm-diameter portion of the piezoelectric layer. Because the diameter of the circular portion free of the piezoelectric layer is 30 μm and the diameter of the circular portion free of the shared electrode 107 is 34 μm, the piezoelectric layer 108 is formed to cover the shared electrode 107 that forms each of the actuators 102. Because the piezoelectric layer 108 covers the shared electrode 107, it is possible to guarantee insulation between the shared electrode 107 and the other wiring electrode 103 for applying a voltage to the piezoelectric layer 108. That is, the piezoelectric layer 108 also insulates the shared electrode 107 from the wiring electrode 103 which functions as the individual electrode for driving the actuator 102.

Figure 7:
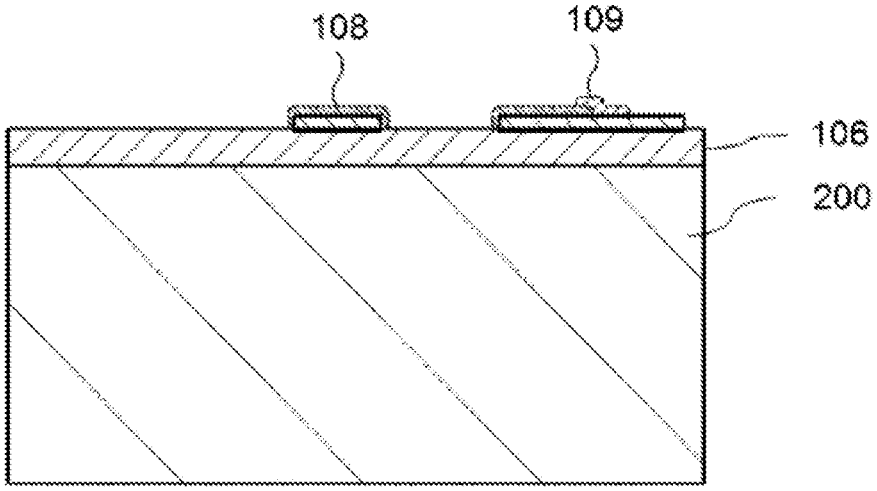
FIG. 7 is a diagram illustrating an insulating layer formed on the shared electrode and the piezoelectric layer in an operational step after the step shown in FIG. 6.

FIG. 7 shows an insulating layer 109 formed on portions of the piezoelectric layer 108 and portions of the shared electrode 107 at the site corresponding to D in FIG. 3. The insulating layer 109 is formed on the piezoelectric layer 108 and the shared electrode 107 to guarantee insulation of the wiring section of the shared electrode 107 and the wiring electrodes 103 that form the actuators 102. In the embodiment, the thickness of the insulating layer is 0.2 μm, and the material thereof is $SiO_2$. The layer is formed using the CVD method, which can produce excellent insulating properties by forming the layer at a low temperature. The insulating layer 109 is formed only on the surface of the piezoelectric layer 108 and the shared electrode 107. For this purpose, patterning is carried out. After coating with the resist, pre-baking is carried out. A mask with a desired pattern is used for an exposure, development and fixing are performed, then followed by post-baking to form the etching mask. The obtained etching mask is used to carry out etching to obtain a desired insulating thin layer. In consideration of the processing unevenness precision of the patterning, the insulating layer 109 is patterned to cover a portion of the piezoelectric layer 108. The quantity of the insulating layer 109 covering the piezoelectric layer 108 is to be limited in such an extent that there is no impediment to the deformation of the piezoelectric layer 108.

FIG. 8 is a diagram illustrating the wiring electrodes 103 formed as a layer on the vibration plate 106, the piezoelectric layer 108 and the insulating layer 109. In the embodiment, the layer thickness of the wiring electrode 103 is 0.5 μm of Pt. The wiring electrodes 103 are formed using the sputtering method. After formation of the electrode layer, the electrode layer is patterned to form the wiring electrodes 103 in a shape corresponding to the actuators 102, the wiring sections, and the wiring electrode terminal sections 104. The patterning is carried out by forming an etching mask on the electrode layer, and the electrode material, except for the portions covered by the etching mask, is etched off. The etching mask is formed by coating a photosensitive resist onto the electrode layer, followed by pre-baking, and then a mask formed in a desired pattern is used for an exposure, development and treatment are performed, followed by post-baking.

The portion of the wiring electrode 103 corresponding to the piezoelectric layer 108 has a circular pattern with an outer diameter of 174 μm. At the center of the circular wiring electrodes 103, the nozzle 101 is formed. For this purpose, a 26-μm-diameter circular portion free of the electrode layer is formed concentric to the center of the circular wiring electrodes 103. That is, the wiring electrode 103 that forms the actuator 102 is shaped to cover the piezoelectric layer 108.

Other materials that can be used in forming the wiring electrode layer 103 include Cu, Al, Ag, Ti, W, Mo, Pt and Au. Also, other layer-forming methods may be used for forming the wiring electrode layer 103, such as the vapor deposition method and gold plating method. The preferable layer thickness of the insulating layer 109 is in the range from 0.01 μm to 1 μm.

FIG. 9 is a diagram illustrating the shape of a circular portion removed from the vibration plate 106 at the center of the circular piezoelectric layer 108, which is the embodiment has a diameter of 26 μm and is formed concentric to the center of each of the actuators 102. The patterning is carried out by forming an etching mask on the wiring electrode layer 103 and the vibration plate 106 followed by removal of the vibration plate 106, except for the portion corresponding to the etching mask by etching. The etching mask is formed by coating a photosensitive resist onto the wiring electrode layer 103 and the vibration plate 106, followed by pre-baking, and then a mask formed in a desired pattern is used for an exposure, development and treatment are performed, followed by post-baking.

FIG. 10 shows a protective layer 110 formed on the vibration plate 106, the wiring electrodes 103, and the shared electrode 107 and the insulating film 109. The protective layer 110 is made of polyimide, and in the embodiment has a layer thickness of 3 μm. The protective layer 110 is formed from a solution containing a polyimide precursor and coated onto vibration plate 106 using a spin coating method. By spin coating, the protective layer 110 is formed to cover the actuators 102, the wiring electrodes 103 and the shared electrode 107 formed on the vibration plate 106, and to be a layer formed with a smooth surface. By patterning and etching, a circular pattern shape with, in the embodiment, a diameter of 20 μm is formed for the nozzle 101, and a square cross section linear shape is formed for the wiring electrode terminal section 104 and the shared electrode terminal section 105 shown in FIG. 3.

The nozzles 101 for ejecting the ink in the ink jet head 1 are formed through the protective layer 110 as seen in FIG. 10. As the nozzle form is etched through the protective layer, in an aperture within the electrode and piezoelectric region at the center of the circular piezoelectric later 108, a thin wall of the material forming the protective layer 110 lines the wall of nozzle 101. The hole through the circular form of the piezoelectric layer has a 26-μm-diameter, formed to surround the circular pattern of the 20 μm nozzle 101 opening.

The inner wall of the 26-μm-diameter circular pattern arranged on the vibration plate 106 and the surface of the wiring electrode 103 are covered by the protective layer 110. Of necessity, the portion of the protective layer 110 corresponding to the wiring electrode terminal section is removed. In the protective layer 110 that covers the inner wall of the circular pattern and the wiring electrode 103, the ink-ejecting nozzle 101 opening communicating with the ink pressure chamber is formed.

When the actuators 102 are formed during the two rounds of patterning the vibration plate 106 and the protective layer 110, due to unevenness in the etching process and limits in the precision of the photomask pattern, the nozzle diameters and the center position of the nozzles in the vibration plate 106 and the protective layer 110 may be different from each other, and the shapes and performance of the individual nozzles of the ink jet head 1 are thus different such that the accuracy of an ink droplet landing in the target position will suffer. However, according to the present embodiment, formation of the actuators 102 is carried out, by virtue of forming an enlarged hole through the piezoelectric layer and filling it with the protective layer material before forming the nozzle 101, only by patterning and etching through the protective layer 110 in the hole so that an improvement in the accuracy and repeatability of the nozzle shape is possible, and an improvement in the accuracy of the position of the ink droplets to meet the desired target position among the plural nozzles is also possible.

The patterning method for the protective layer 110 when non-photosensitive polyimide is used is different from the patterning method when photosensitive polyimide is used.

When the non-photosensitive polyimide is in use (in this application example, Semicofine manufactured by Toray Industries, Inc., is used), after a solution containing the polyimide precursor is used to form a layer according to the spin coating method, baking is carried out for thermal polymerization and removal of the solvent followed by sintering. Then, an etching mask is formed on the non-photosensitive polyimide layer, and the polyimide layer, except for the portion corresponding to the etching mask, is etched off. Here, the etching mask is formed by coating a photosensitive resist onto the non-photosensitive polyimide layer, followed by pre-baking, and then a mask formed in a desired pattern is used for an exposure, development and treatment are performed and, followed by post-baking.

When a photosensitive polyimide is used (according to this application example, Photoneece manufactured by Toray Industries, Inc., is used), after the layer is formed according to the spin coating method, pre-baking is carried out. Then, exposure is carried out using a mask for exposure; more specifically, a mask that opens (to let light pass) for the nozzles 101, the wiring electrode terminal sections 104 and the shared electrode terminal sections 105 is used when a positive-type photosensitive polyimide is in use. Or, a mask that blocks light for the nozzles 101, the wiring electrode terminal sections 104 and the shared electrode terminal sections 105 is used when a negative-type photosensitive polyimide is in use. Exposure is followed by the development and treatment, and then post-baking for selective reaction of the exposed versus unexposed regions is carried out.

In addition to polyimide, the protective layer 110 may also be made of other types of resin materials such as ABS (acrylonitrile butadiene styrene), polyacetal, polyamide, polycarbonate, polyether sulfone, and other plastic materials. Also, one may also use ceramic materials such as zirconia, silicon carbide, silicon nitride, barium titanate, and other nitrides and oxides. When insulation of the wiring electrodes 103 and the shared electrode 107 can be guaranteed, one may also use a metal material (alloy). Typical metal materials that may be used in this case include aluminum, SUS, titanium, etc. In addition, other layer-forming methods may also be used, such as CVD, vapor deposition, gold plating, etc. The layer thickness of the protective layer 110 is preferably in the range from 1 μm to 50 μm.

When the material for the protective layer 110 is selected, it is preferable that the Young's modulus of the protective layer 110 be significantly different from the Young's modulus of the material used for the vibration plate 106; that is, the materials for the vibration plate 106 and the protective layer 110 should have significantly different Young's moduli. The quantity of deformation of the plate shape is affected by the Young's modulus and the plate thickness of the material for the plate. When the same force acts on the two different materials, the lower the Young's modulus of the vibration plate 106 or the thinner the vibration plate 106 thickness, the larger the deformation of the vibration plate 106. In the embodiment, the Young's modulus of the $SiO_2$ layer for the vibration plate 106 is 80.6 GPa, and the Young's modulus of the polyimide layer of the protective layer 110 is 10.9 GPa. The difference between their Young's moduli is 69.7 GPa. The following is an explanation of the reason to provide this difference.

According to this embodiment, the ink jet head 1 has a configuration in which the actuator 102 is located on the body of the vibration plate 106 (the actuator 102 is formed thereon) having the protective layer 110 coated thereover. When an electric field is applied to the actuator 102 so that the actuator 102 stretches in the direction orthogonal to the electric field direction, a force is created on the vibration plate 106 to deform the vibration plate into a concave shape on the side thereof facing the ink pressure chamber 201 side. In contrast, the force causes the protective layer 110 thereon to be deformed into a convex shape on the side facing away from the ink pressure chamber 201. When the actuator 102 contracts in the direction orthogonal to the electric field direction by reversing the bias on the piezoelectric layer 108, a force is applied so that the vibration plate 106 is deformed into a convex shape on the side thereof facing the ink pressure chamber 201, and the protective layer 110 is deformed into a concave shape. That is, as the actuator 102 stretches/contracts in the direction orthogonal to the electric field direction, forces are applied to the vibration plate 106 and the protective layer 110 so that they are in opposite directions. Consequently, if the vibration plate 106 and the protective layer 110 have the same layer thickness and the same Young's modulus, even when a voltage is applied to the actuator 102, because the forces that are applied to the vibration plate 106 and the protective layer 110 cause deformation of the same magnitude but in opposite directions, there is no deformation for the nozzle plate 100, and no ink is ejected.

According to the present embodiment, when the protective layer 110 is a polyimide layer, because the Young's modulus of the protective layer 110 is lower than the Young's modulus of the $SiO_2$ layer of the vibration plate 106, under the same force, the magnitude of the deformation of the protective layer 110 is larger. According to the configuration of the present embodiment, when the actuator 102 stretches in the direction orthogonal to the electric field direction, the nozzle plate 100 is deformed into a convex shape with respect to the ink pressure chamber 201 side so that the volume of the ink pressure chamber 201 becomes smaller (because the magnitude of the deformation when the protective layer 110 is deformed into a convex shape with respect to the ink pressure chamber 201 side is larger). In contrast, when the actuator 102 contracts in the direction orthogonal to the electric field direction, the nozzle plate 100 is deformed into a concave shape with respect to the ink pressure chamber 201 side, and the volume of the ink pressure chamber 201 becomes larger (because the magnitude of the deformation when the protective layer 110 is deformed into a concave shape with respect to the ink pressure chamber 201 side is larger).

When the same voltage is applied to the actuator, the larger the difference between the Young's moduli of the vibration plate 106 and the protective layer 110, the larger the difference in the magnitude of the deformation of the vibration plate. Consequently, when the difference between the Young's moduli of the vibration plate 106 and the protective layer 110 is larger, it is possible to eject the ink at a lower voltage.

In addition, as explained above, the magnitude of the deformation of the plate shape depends not only on the Young's modulus of the plate material but also on the plate thickness. Consequently, when increasing a difference in the magnitude of the deformation between the vibration plate 106 and the protective layer 110, in addition to the Young's moduli of the materials, respective layer thicknesses also should be taken into consideration. Even when the material of the vibration plate 106 and the material of the protective layer 110 have the same Young's modulus, if there is a difference in the layer thickness, then ink can still be ejected, but the required voltage to eject the same volume of ink is higher.

In addition, when the material of the protective layer 110 is selected, consideration is also made for its heat resistance, the insulating properties (in consideration of the influence of the denaturing of the ink due to driving by the actuators 102 when an ink with a high electroconductivity is in use), the thermal expansion coefficient, the smoothness, and its wettability to the ink.

Figure 11:
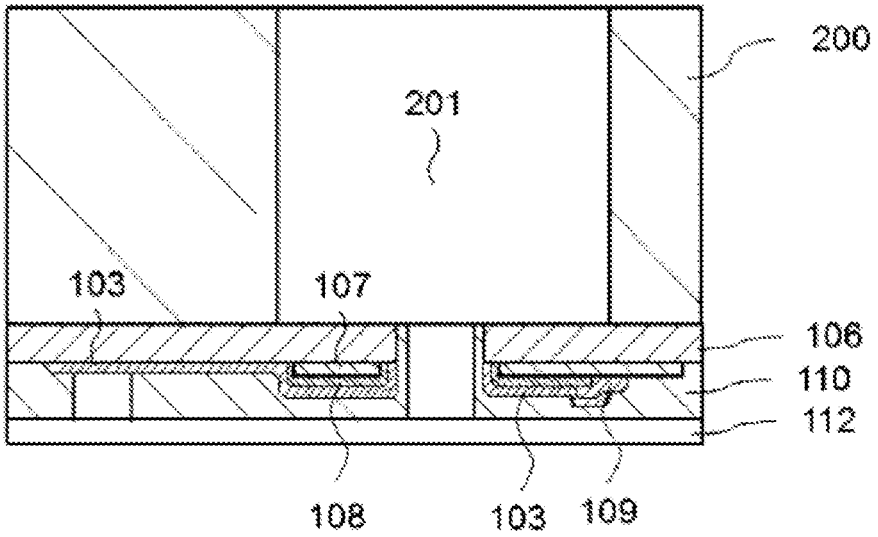
FIG. 11 is a diagram illustrating a state in which an ink pressure chamber structural body is arranged with respect to the flipped ink pressure chamber structural body in an operational step after the step shown in FIG. 10.

As shown in FIG. 11, a protective layer cover tape 112 is applied to the protective layer 110, and the ink pressure chamber structural body 200 is flipped so that the ink pressure chamber 201 formed in the ink pressure chamber structural body 200 is shown. Here, the ink pressure chamber 201 has a cylindrical shape with a diameter, in the embodiment, of 240 μm, and patterning is carried out so that the center of the ink pressure chamber 201 and the center of the nozzle 101 are aligned, or nearly aligned, with each other. This chamber structural body 200 with the actuator 102 formed thereon is flipped with respect to FIG. 10.

In the following, the method for patterning the ink pressure chamber will be explained. The protective layer cover tape 112 is applied to the protective layer 110 shown in FIG. 11. Here, the protective layer cover tape 112 is a back-surface protective layer for protection of the back surface during polishing (chemical mechanical polishing, CMP, of the silicon wafer).

An etching mask is formed on the ink pressure chamber structural body 200 made of a 725-μm-thick silicon wafer, and, as described in the patent application WO2003/030239 filed by Sumitomo Precision Industrial Co., Ltd., the anisotropic dry etching process technology known as Deep-RIE is used to remove the silicon in locations which are not masked by the etching mask portion to form the ink pressure chamber 201. Here, the etching mask is formed by coating a photosensitive resist onto the ink pressure chamber structural body 200, followed by pre-baking, and then a mask with a desired pattern formed on it is used for an exposure, development and treatment are performed, followed by post-baking.

For the Deep-RIE used solely for the silicon substrate, the SF6 is used as the etching gas. However, the SF6 gas is selective, as it does not exhibit an etching effect on the $SiO_2$ layer of the vibration plate 106 and the polyimide layer of the protective layer 110. Consequently, the progress of the dry etching of the silicon that forms the ink pressure chamber 201 stops at the vibration plate 106. That is, the $SiO_2$ layer of the vibration plate 106 plays the role of the etch stop layer for the RIE etching operation.

Figure 12:
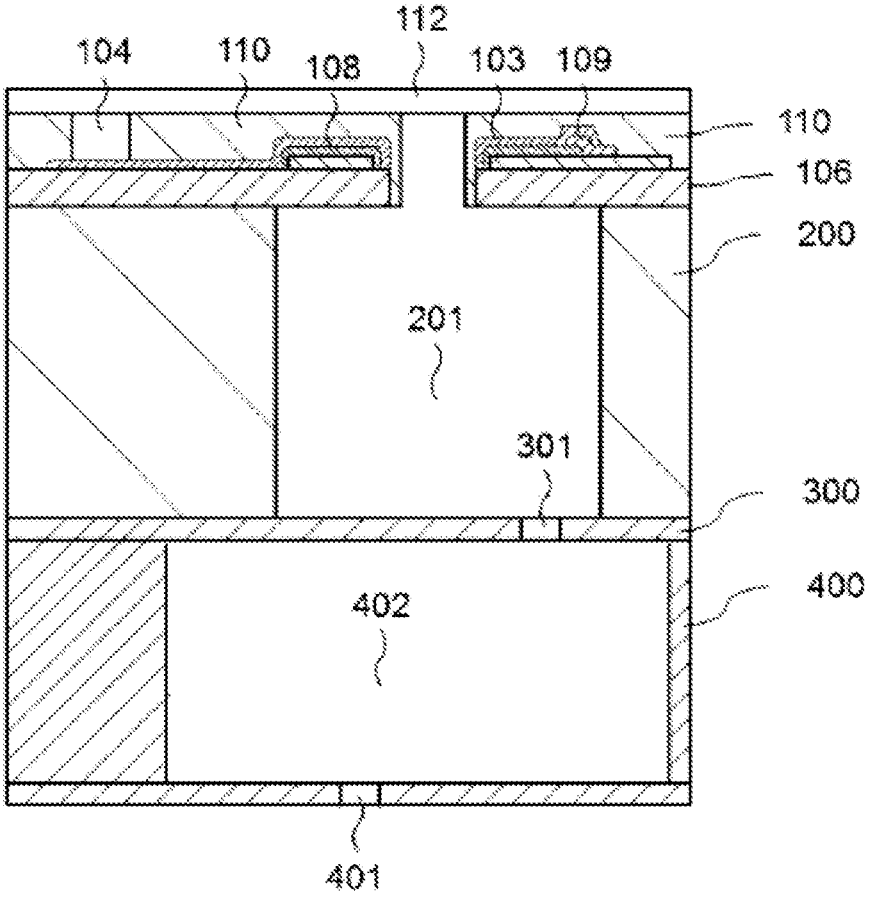
FIG. 12 is a diagram illustrating a state in which a separate plate and an ink-feeding path structural body are boned to the ink pressure chamber structural body in an operational step after the step shown in FIG. 11.

In the above explanation, one may also appropriately select from the wet etching method using a chemical solution and the dry etching method using plasma to form the ink pressure chamber 201 in the silicon wafer. Depending on the materials of the insulating layer, the electrode layer, the piezoelectric layer, etc., the etching method and the etching conditions may need to be changed to carry out the processing using a different etchant/process. After the end of the etching processing using each photosensitive resist layer, the residual photosensitive resist layer is removed using a dissolving solution. FIG. 12 shows the cross-section of the structure where the separation plate 300 and the ink-feeding path structural body 400 are bonded to the ink pressure chamber structural body 200. Here, an epoxy resin adhesive is used for bonding. After the separation plate 300 and the ink-feeding path structural body 400 are bonded together, the separation plate 300 is bonded to the ink pressure chamber structural body 200.

According to the present embodiment, the nozzle plate 100 is composed of the vibration plate 106, shared electrode 107, the wiring electrode 103, the piezoelectric layer 108, and the passivation film 110, all of which are formed on the ink pressure chamber structural body 200. Instead of the method in which the nozzle plate 100 is affixed to the ink pressure chamber structural body 200, one surface of the ink pressure chamber structural body 200 is formed as the vibration plate. On one surface of the ink pressure chamber structural body 200, the electrodes and the piezoelectric layer are formed. From the other surface side, a hole that does not go through the ink pressure chamber structural body 200 is formed at the position corresponding to the ink pressure chamber. On the one side of the ink pressure chamber structural body 200, a thin layer is left, and this portion functions as the vibration plate. With this forming method, it is possible to use a portion of the ink pressure chamber structural body 200 as the nozzle plate 100 without using the nozzle plate 100.

Figure 13:
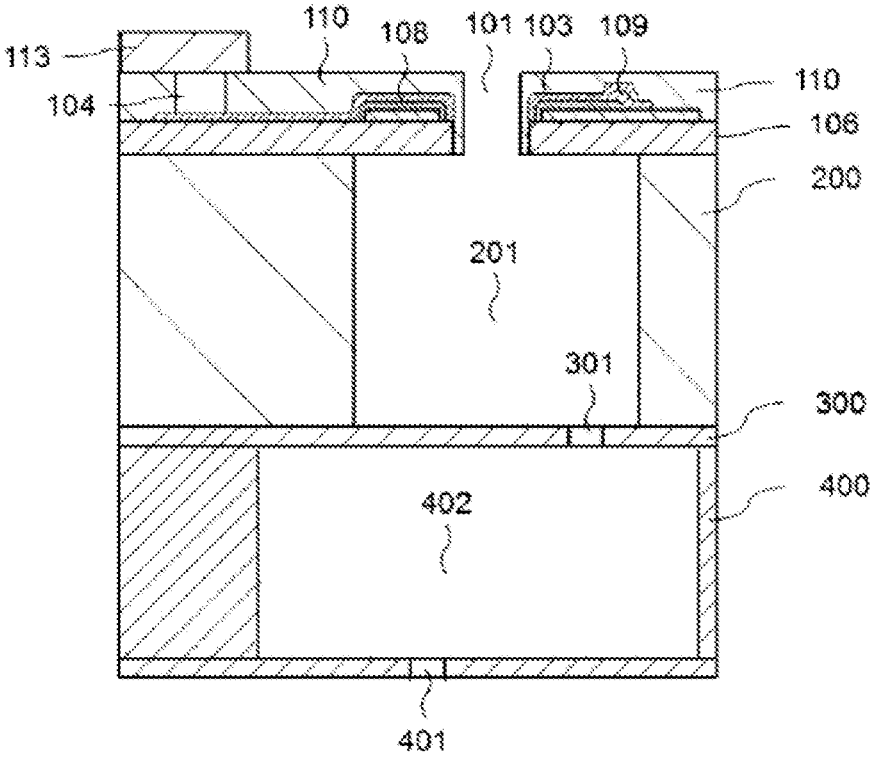
FIG. 13 is a diagram illustrating a state in which an electrode terminal section cover tape is bonded to a protective layer wiring electrode terminal section in an operational step after the step shown in FIG. 12.

FIG. 13 shows the cross-section of the structure where an electrode terminal section cover tape 113 is bonded to the wiring electrode terminal section 104 of the protective layer 110. Here, by irradiating UV light from the protective layer cover tape 112 side shown in FIG. 12, the bonding strength of the protective layer cover tape 112 is decreased for separation. Then, as shown in FIG. 3, in the region of the wiring electrode terminal section 104 and the shared electrode terminal section 105, the electrode terminal section cover tape 113 is applied. This cover tape is made of a resin, and the bonding strength is equal to cellophane tape, which allows easy removal. The electrode terminal section cover tape 113 is bonded to prevent dirt from sticking to the wiring electrode terminal section 104 and the shared electrode terminal section 105 and to prevent the attachment of an ink-repulsive layer 114 when the ink-repulsive layer 114 is formed as to be explained later.

Figure 14:
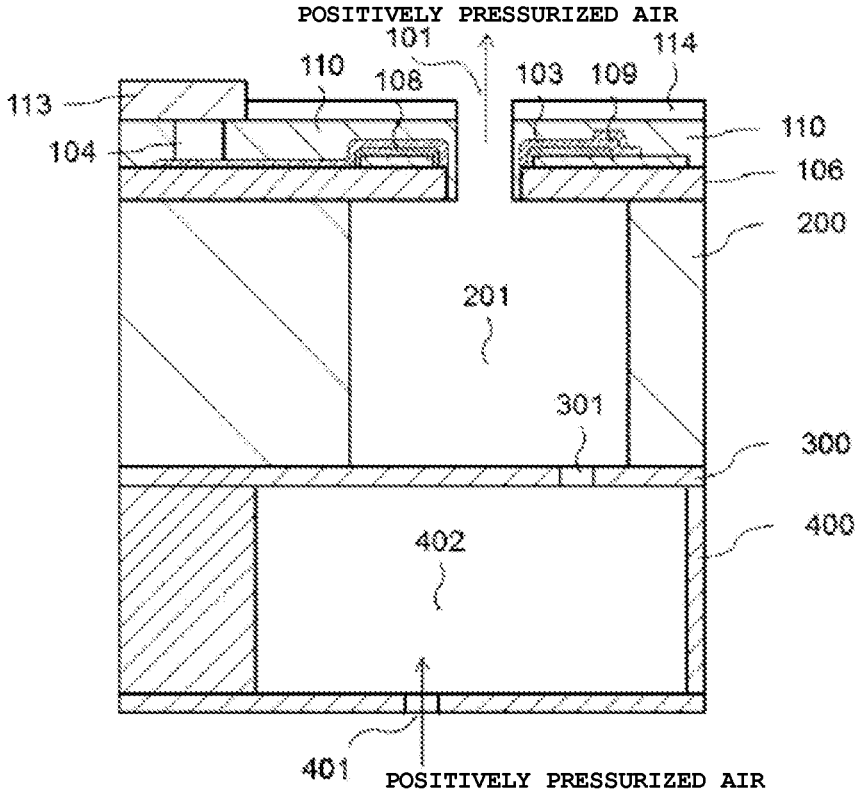
FIG. 14 is a diagram illustrating a state in which an ink-repulsion layer is formed on the protective layer in an operational step after the step shown in FIG. 13.

FIG. 14 shows a cross-section of the structure where the ink-repulsive layer 114 is formed on the protective layer 110, except for on a portion of the inner wall of the nozzles 101. Examples of the materials of the ink-repulsive layer 114 include silicone base liquid-repulsive materials having liquid-repulsive property and fluorine-containing organic materials. In the present embodiment, Cytop manufactured by Asahi Glass Co., Ltd., a commercially available fluorine-containing organic material, is used. In the embodiment, the layer thickness of the ink-repulsive layer 114 is 1 μm.

The ink-repulsive layer 114 is formed by spin coating a liquid ink-repulsive layer material onto the protective layer 110. When the spin coating is carried out together with anchoring of the ink jet head 1, positively pressurized air is injected through the ink-feeding port 401. As a result, the positively pressurized air is exhausted from the nozzles 101 connected to the ink-feeding port 401. In this state, as the liquid ink-repulsive layer material is applied, the ink-repulsive layer 114 is formed only on the protective layer 110 without attaching the ink-repulsive layer material onto the ink-flow channel of the inner wall of the nozzles 101.

Figure 15:
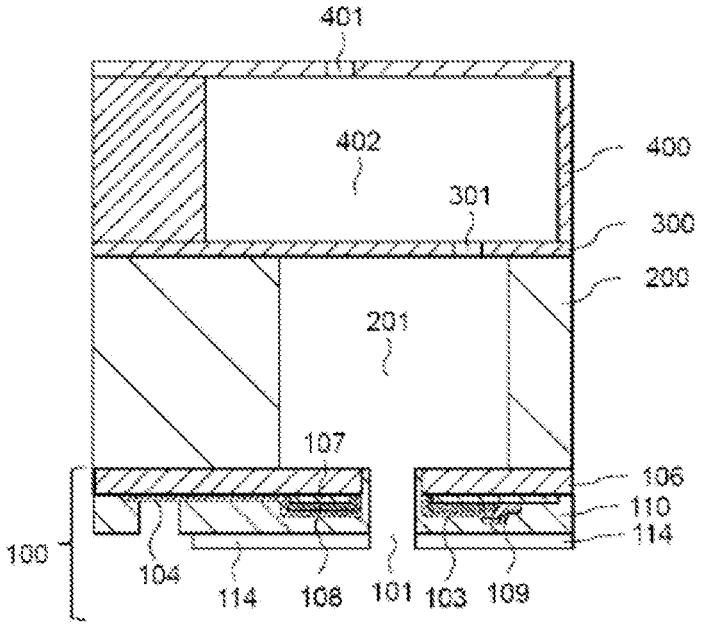
FIG. 15 is a cross-sectional view illustrating the ink jet head completed after the operational steps shown in FIG. 4 to FIG. 14.

FIG. 15 shows the cross-section of a finished or complete ink jet head 1. The ink is fed from the ink-feeding port 401 arranged in the ink-feeding path structural body 400 to the ink-feeding path 402. The ink in the ink-feeding path flows through ink throttles 301 to the various ink pressure chambers 201 to fill the pressure chambers 201 of the respective nozzles 101. The ink fed from the ink-feeding port 401 is maintained at an appropriate negative pressure so that the ink in the nozzles 101 is held without leaking from the nozzles 101.

Figure 16:
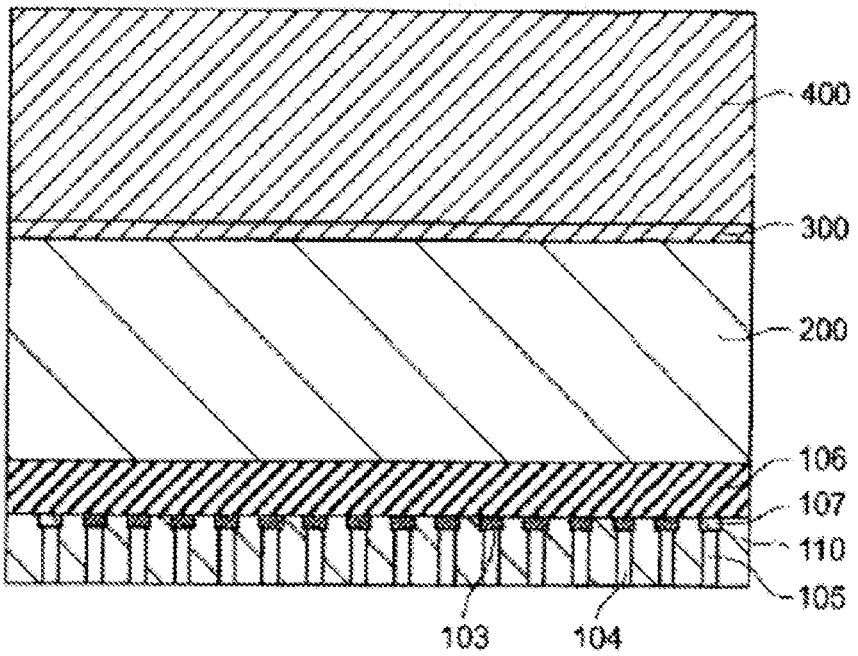
FIG. 16 is a cross-sectional view taken across the B-B' axis of the ink jet head shown in FIG. 3.

FIG. 16 is a cross-sectional view taken across the B-B' axis of FIG. 3 of the wiring electrode terminal section 104 and the shared electrode terminal section 105. The protective layer 110 is etched only to correspond to the wiring electrode terminal section 104 and the shared electrode terminal section 105, and the ink-repulsive layer 114 is not formed on the protective layer 110.

Figure 17:
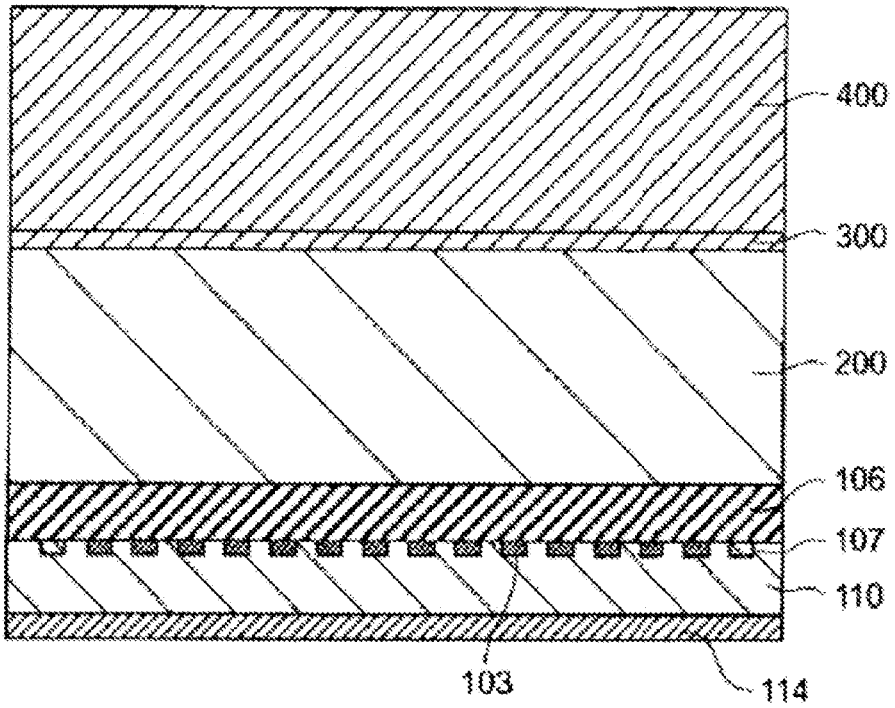
FIG. 17 is a cross-sectional view taken across the C-C' axis of the ink jet head shown in FIG. 3.

FIG. 17 is a cross-sectional view taken across the C-C' axis in FIG. 3 of the wiring electrodes 103 and the shared electrode terminal section 105. FIG. 17 differs from FIG. 8 in that the protective layer 110 is formed on the wiring, and the ink-repulsive layer 114 is also formed on the protective layer 110.

Second Embodiment

Figure 18:
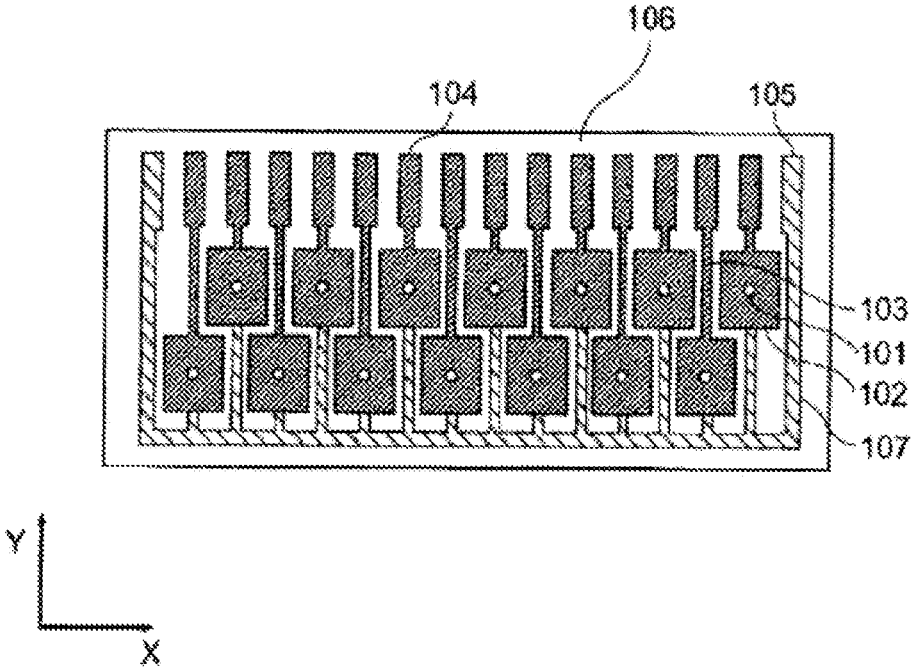
FIG. 18 is a diagram illustrating an ink jet head in a second embodiment.

FIG. 18 is a diagram illustrating the ink jet head 1 in a second embodiment. This embodiment differs from the first embodiment in the shape of the actuators 102. Otherwise, the configuration is the same.

The actuators 102 are in a rectangular shape. In the embodiment, each of the actuators 102 has a rectangular shape with a width of 170 μm and a length of 340 μm. The diameter of the nozzles 101 is 20 μm. The shape of the ink pressure chamber 201 is fitted to the shape of the piezoelectric layer 108, and the ink pressure chamber 201 also has a rectangular shape.

In contrast to the circular piezoelectric layer pattern, the actuators 102 each have a size of 340 μm in the longitudinal direction. Consequently, the actuators for ejecting the ink are larger. As a result, it is possible to have a higher pressure for ejecting the ink.

Third Embodiment

Figure 19:
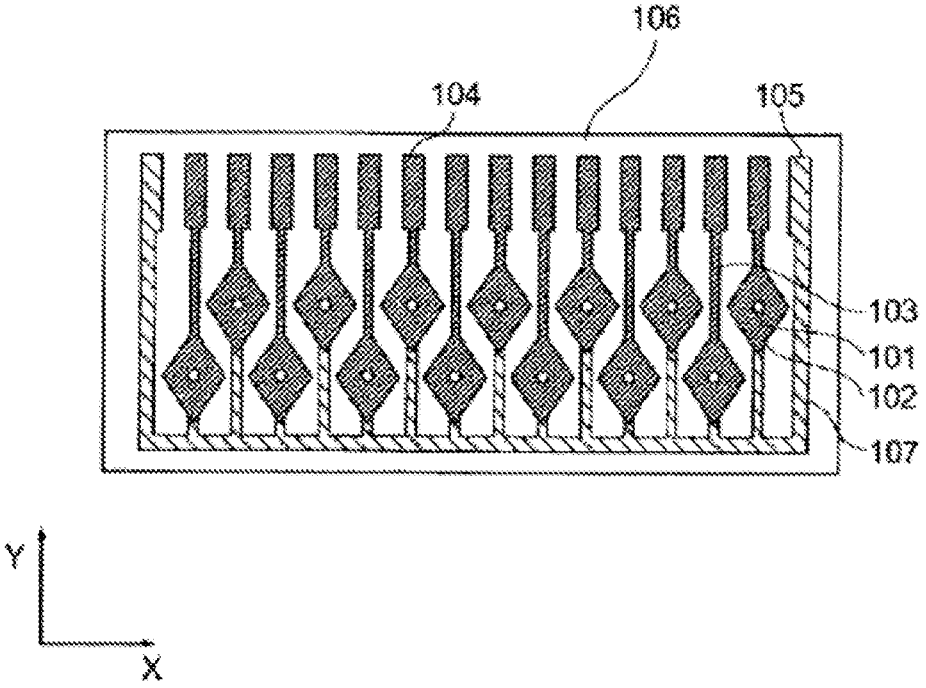
FIG. 19 is a diagram illustrating an ink jet head in a third embodiment.

FIG. 19 is a diagram illustrating the ink jet head 1 in a third embodiment. This embodiment differs from the first embodiment in the shape of the actuators 102. Otherwise, the configuration is the same.

The actuators 102 are in a rhomboid (parallelepiped) shape. In the embodiment, each of the actuators 102 has a rhomboid shape with a width of 170 μm and a length of 340 μm. The diameter of the nozzles 101 is 20 μm. The shape of the ink pressure chamber 201 is fitted to the shape of the actuators 102, and the ink pressure chamber 201 also has a rhomboid shape.

In contrast to the circular piezoelectric layer pattern of the first embodiment, the piezoelectric pattern can be more closely packed to provide a higher density of nozzles.

Fourth Embodiment

Figure 20:
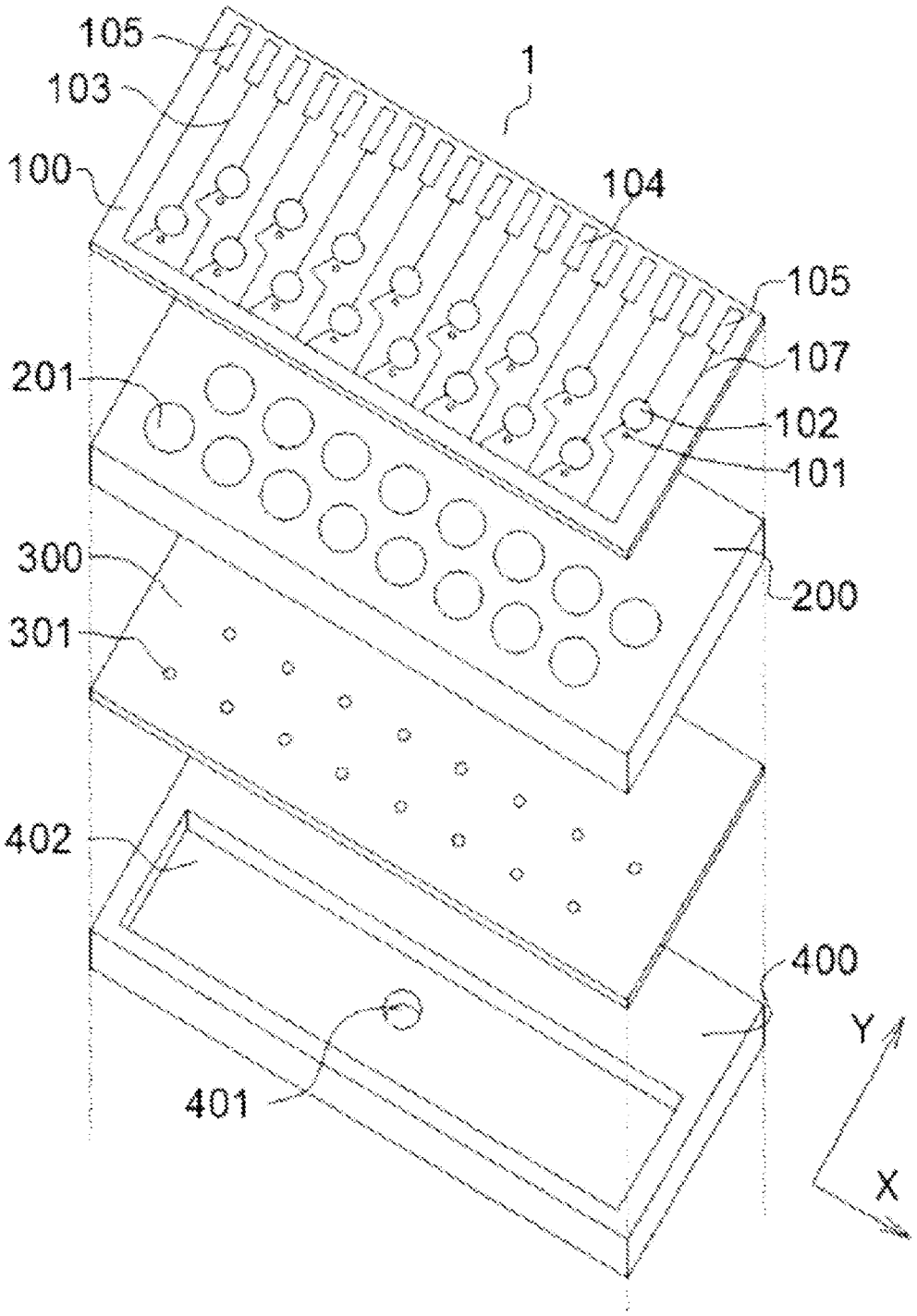
FIG. 20 is a diagram illustrating an ink jet head in a fourth embodiment.

FIG. 20 is an oblique exploded view illustrating the ink jet head 1 in a fourth embodiment. This embodiment differs from the first embodiment in that the actuators 102 are offset from, i.e., do not overlie, the nozzles 101. The center of a nozzle 101 is at a position offset from the center of the circular cross-section of one ink pressure chamber 201 corresponding thereto. The ink pressure chamber 201 overlies both the actuator 102 and the nozzle 101. Other than the nozzles 101 being positioned offset from the position of the actuators 102, this embodiment is the same as the first embodiment.

Figure 21:
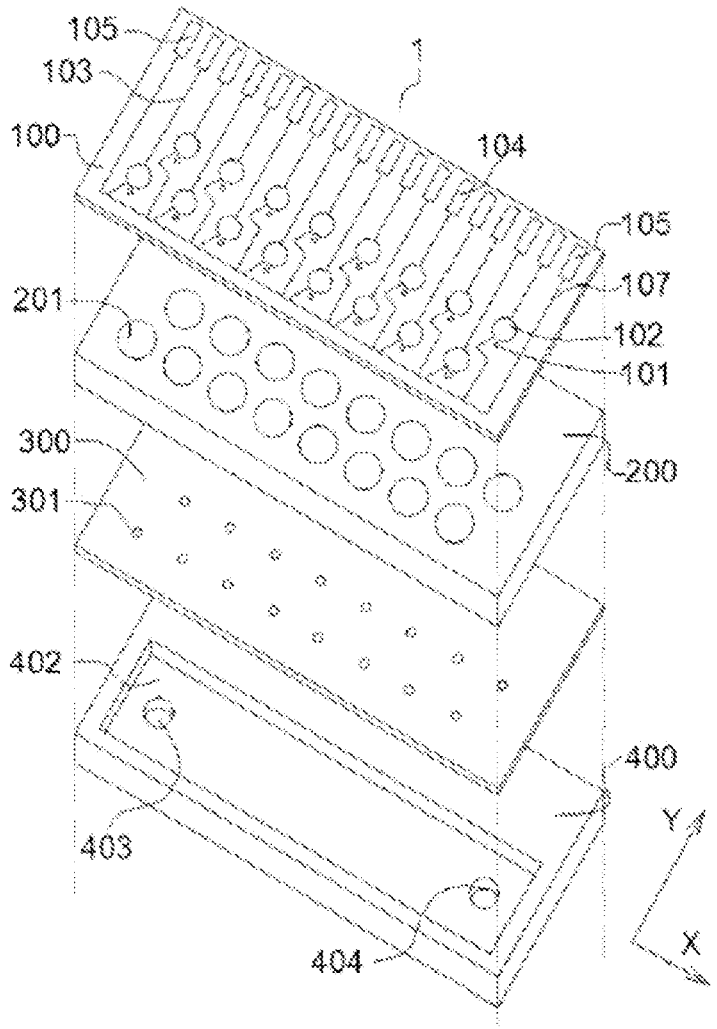
FIG. 21 is a diagram illustrating the ink jet head in the fourth embodiment as another example that is different from the diagram shown in FIG. 20.

FIG. 21 differs from FIG. 20 in that the circulating ink-feeding port 403 and the circulating ink-exhausting port 404 are arranged near the two ends of the ink-feeding path 402 so that the ink is circulated in the ink-feeding path 402.

Figure 22:
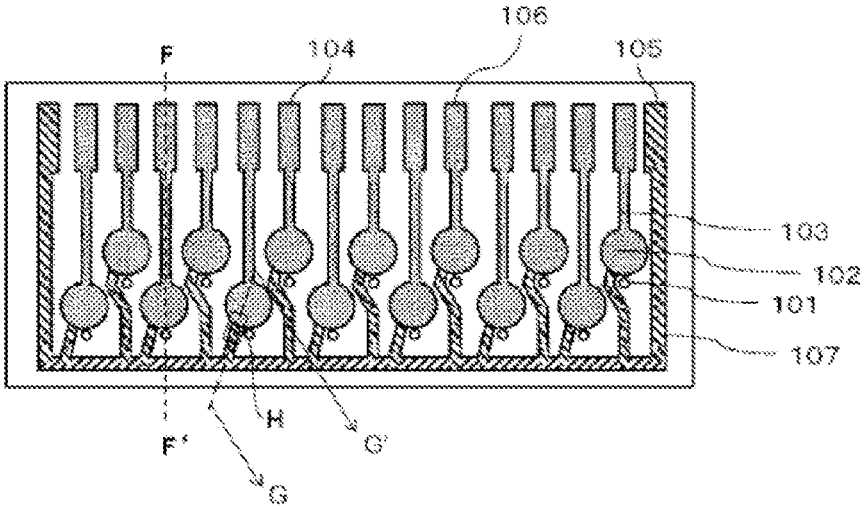
FIG. 22 is a plane view of a nozzle plate shown in FIG. 21 as viewed from an ink-ejecting side.

FIG. 22 is a plane view illustrating the nozzle plate 100 in the fourth embodiment as viewed from the ink-ejecting side. Here, the nozzles 101 extend through the nozzle plate 100. The center of the corresponding nozzle 101 is position offset from the center of the circular cross-section of one ink pressure chamber 201. The piezoelectric layer has, in this embodiment, a circular shape. The piezoelectric layer is located at a position different from the nozzle 101, such that the nozzle 101 is fully offset from the position of the piezoelectric layer 108. In the embodiment, the diameter of the circular piezoelectric layer is 170 μm. The center of the piezoelectric layer is at a position offset from the center of the circular cross-section of the ink pressure chamber 201 and a small space exists between the nozzle 101 and the closest surface of the piezoelectric layer 108. According to this embodiment, the center of the piezoelectric layer is at a position offset from the center of the circular cross-section of the ink pressure chamber 201. However, one may also use a scheme in which the center of the circular cross-section of the ink pressure chamber 201 and the center of the piezoelectric layer are at the same position.

Figure 23:
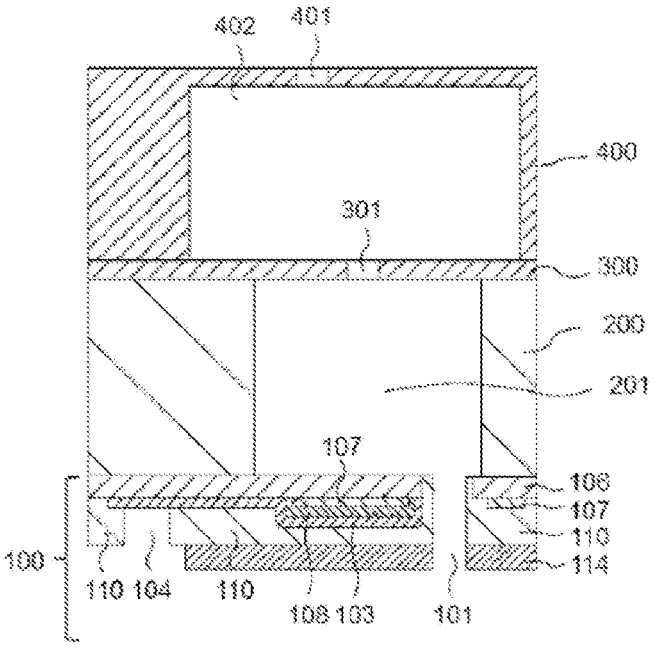
FIG. 23 is a cross-sectional view taken across the F-F' axis of the ink jet head shown in FIG. 22.

FIG. 23 is a cross-sectional view taken across the F-F' axis shown in FIG. 22. This view differs from the first embodiment shown in FIG. 15 in that no region free of the layer formed by circular-shaped patterning is formed for locating the nozzle at the center of the shared electrode 107 and the piezoelectric layer 108 or the wiring electrode 103 of the actuator 102 portion. Just as in the first embodiment, the nozzles 101 are formed on the protective layer 110; that is, circular openings with a diameter of 26 μm are formed on the vibration plate 106 to surround the 20-μm-diameter circular pattern of the protective layer 110. The manufacturing process in the fourth embodiment is the same as that in the first embodiment other than the patterning shape which is different.

Figure 24:
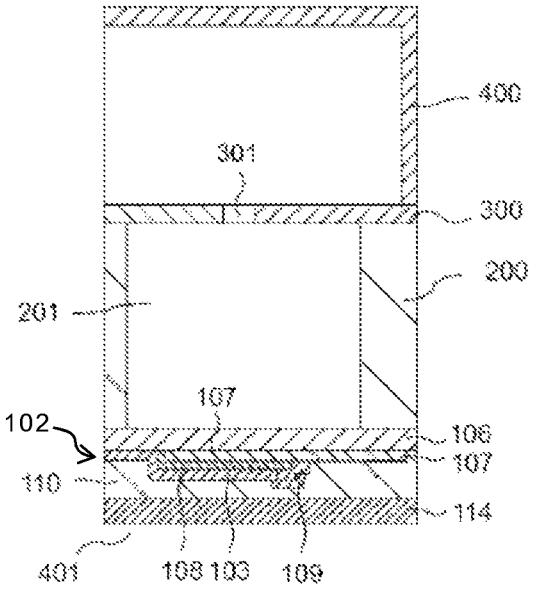
FIG. 24 is a cross-sectional view taken across the G-G' axis of the ink jet head shown in FIG. 22.

FIG. 24 is a cross-sectional view of the actuator 102 portion taken across the G-G' axis in FIG. 22. It differs from FIG. 22 for the cross-sectional view taken across the F-F' axis shown in FIG. 22 in that the insulating layer 109 is between the actuator 102 and the shared electrode 107 at the site corresponding to H in FIG. 22.

According to the first embodiment, there should be a circular patterning operation to form the nozzle at the center of the shared electrode 107, the piezoelectric layer 108 and the wiring electrodes 103 of the actuator 102 portion. However, according to the fourth embodiment, such a circular patterning operation is not needed. Consequently, it is possible to avoid the tolerance issues in the positioning of the nozzle within the aperture in the piezoelectric layer. As a result, compared with the first embodiment, in this embodiment yield issues related to the ink ejection repeatability of the ink jet head 1 can be improved.

Fifth Embodiment

Figure 25:
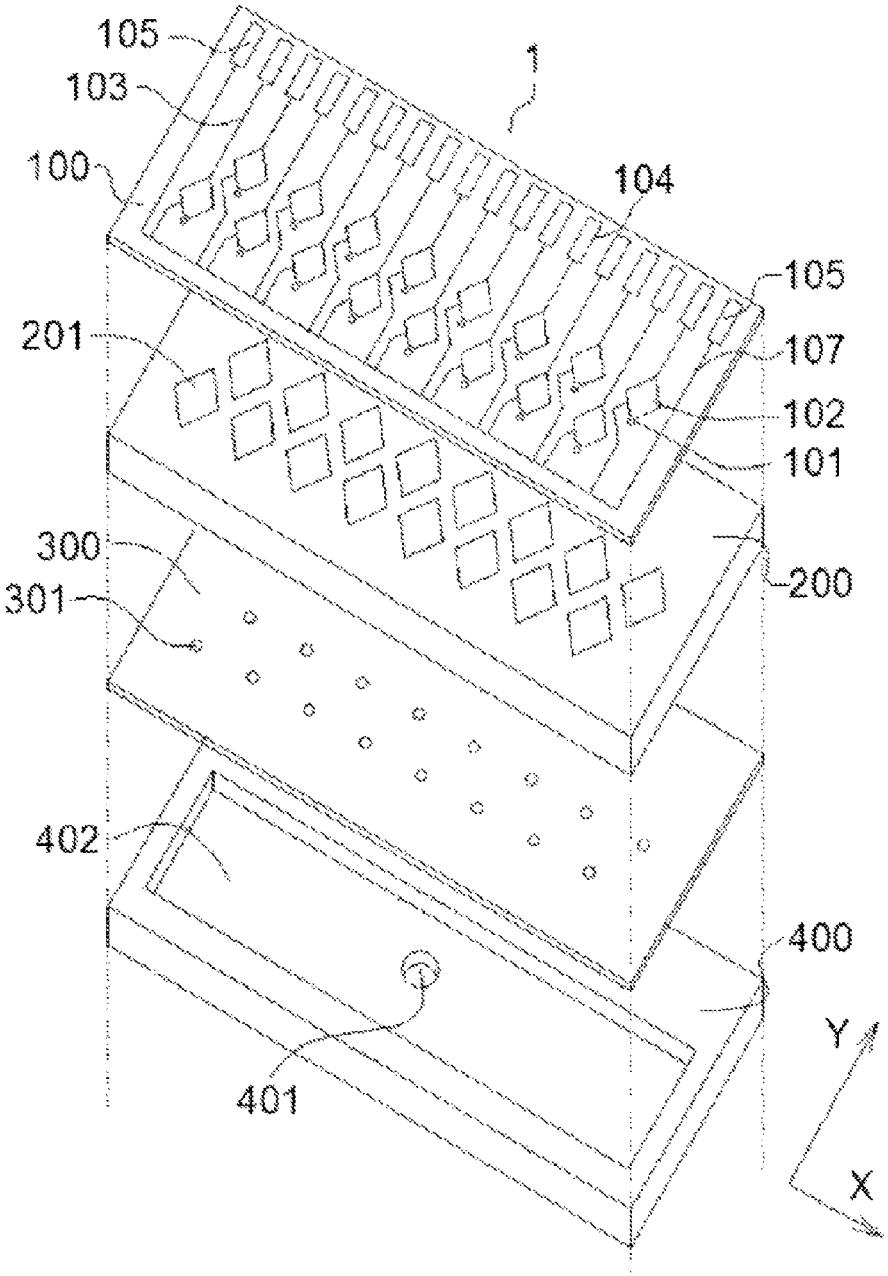
FIG. 25 is a diagram illustrating an ink jet head in a fifth embodiment.

FIG. 25 is an oblique exploded view illustrating the ink jet head 1 in a fifth embodiment. This embodiment differs from the fourth embodiment in the shapes of the ink pressure chambers 201 and the actuators 102. Otherwise, the configuration is the same.

The ink pressure chambers 201 and the actuators 102 are in a rhomboid shape. In this embodiment the actuators 102 are in a rhomboid (parallelepiped) shape with a width of 170 μm and length of 340 μm. The diameter of the nozzles 101 is 20 μm, and the actuators 102 and the nozzles 101 are at positions different from each other. Each ink pressure chamber 201 surrounds the actuator 102 and the nozzle 101.

Compared with the circular piezoelectric layer pattern, the piezoelectric pattern can be arranged at a higher density.

Figure 26:
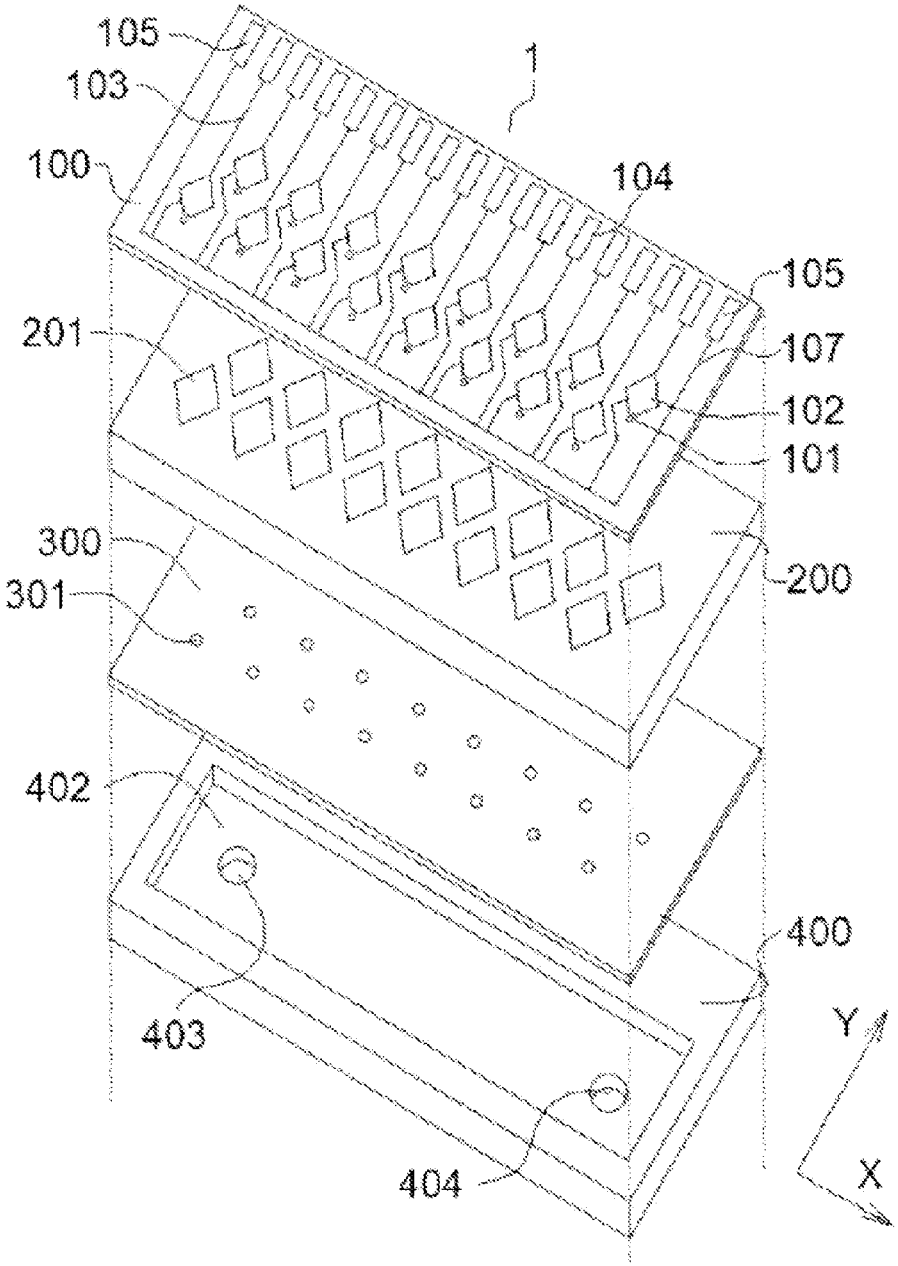
FIG. 26 is a diagram illustrating the ink jet head in the fifth embodiment as another example that is different from the diagram shown in FIG. 25.

FIG. 26 differs from FIG. 25 in that the circulating ink-feeding port 403 and the circulating ink-exhausting port 404 are arranged near the two ends of the ink-feeding path 402 so that the ink is circulated in the ink-feeding path 402.

Sixth Embodiment

Figure 27:
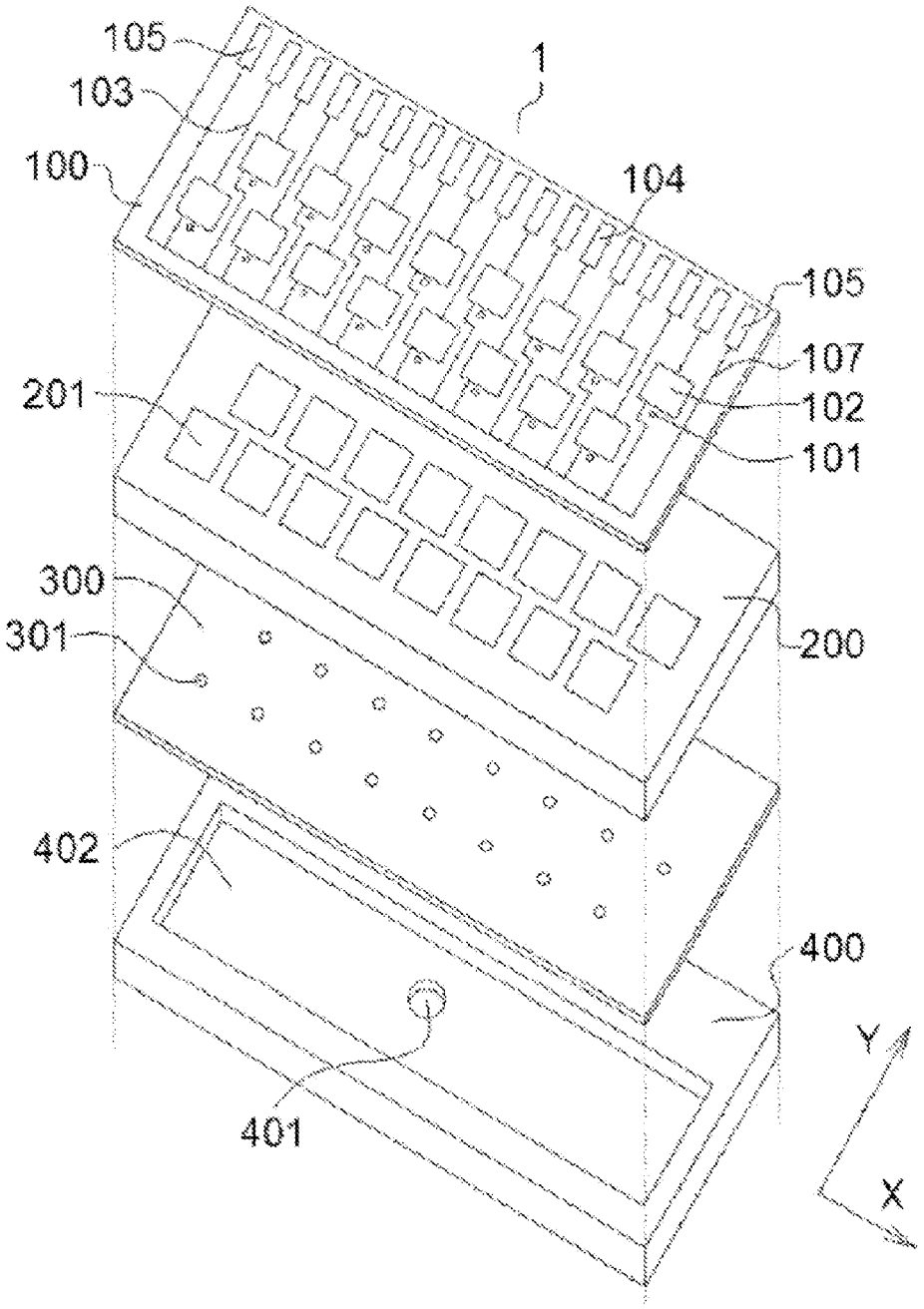
FIG. 27 is a diagram illustrating an ink jet head in a sixth embodiment.

FIG. 27 is an oblique exploded view of the ink jet head 1 in a sixth embodiment. This embodiment differs from the fourth embodiment in the shapes of the ink pressure chambers 201 and the actuators 102. Otherwise, the configuration is the same.

The ink pressure chambers 201 and the actuators 102 are in a rectangular shape. In this embodiment, the actuators 102 each have a rectangular shape with a width of 250 μm and a length of 220 μm. The diameter of the nozzles 101 is 20 μm, and the actuators 102 and the nozzles 102 are at positions different from each other. The ink pressure chamber 201 surrounds the actuator 102 and the nozzle 101.

Compared with the circular piezoelectric layer pattern, the actuators 102 have a larger area, so that a higher ink ejecting pressure is possible.

Figure 28:
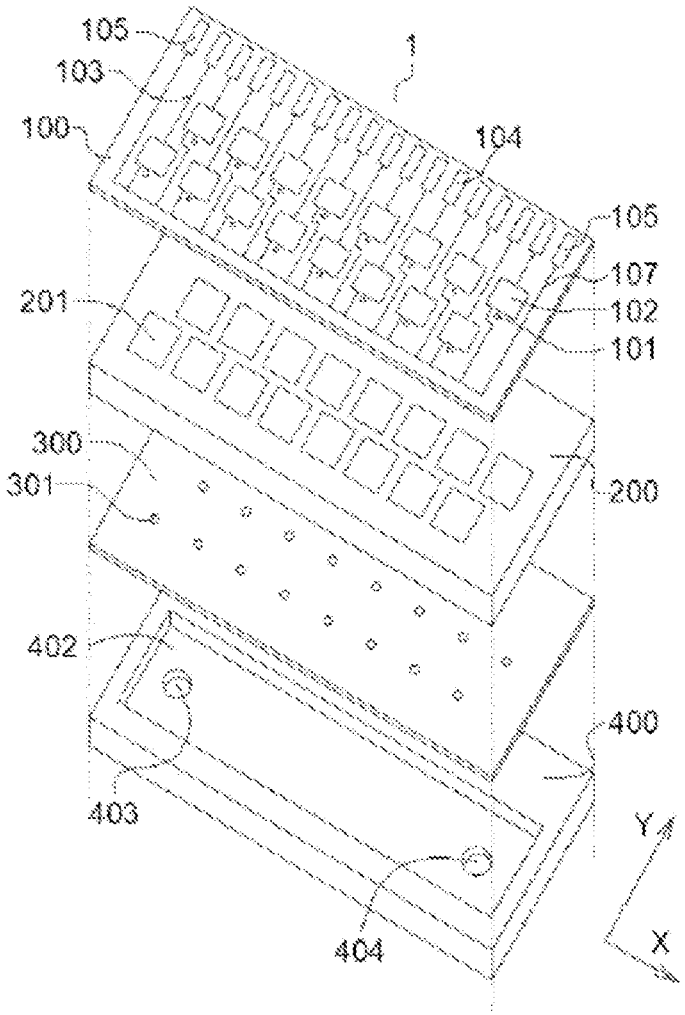
FIG. 28 is a diagram illustrating the ink jet head in the sixth embodiment as another example that is different from the diagram shown in FIG. 27.

FIG. 28 differs from FIG. 27 in that the circulating ink-feeding port 403 and the circulating ink-exhausting port 404 are arranged near the two ends of the ink-feeding path 402 so that the ink is circulated in the ink-feeding path 402.

While certain embodiments have been described, these embodiments have been presented by way of example only and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head comprising:

a vibration plate having a first and a second surface and an opening of a first diameter extending therethrough from the first to the second surface;

an ink pressure chamber, communicating with the opening and arranged on the first surface of the vibration plate;

a first electrode formed on the second surface of the vibration plate;

a piezoelectric layer formed on the first electrode in a region adjacent to the opening, and that, in response to a driving voltage, deforms the vibration plate so that the vibration plate goes convex or concave to expand or contract the volume of the ink pressure chamber;

a second electrode formed on the piezoelectric layer;

a protective layer which is at least formed over the vibration plate and the second electrode and covers inside surface of the opening to form a nozzle for ejecting the ink and having a second diameter smaller than the first diameter; and an ink-feeding port fluidly coupled to the ink pressure chamber.

2. The ink jet head of claim 1, wherein a plurality of the nozzles are collectively formed on the vibration plate.

3. The ink jet head of claim 1, wherein one of the first and the second electrodes is electrically interconnected to a common bus.

4. The ink jet head of claim 3, wherein one of the first and the second electrodes is electrically connected to an independent contact pad.

5. The ink jet head of claim 1, wherein the piezoelectric layer surrounds the nozzle.

6. The ink jet head of claim 5, wherein the nozzle is formed to overlie a central position of the ink pressure chamber.

7. The ink jet head of claim 1, wherein the piezoelectric layer is offset to the side of the nozzle.

8. The ink jet head according to claim 1, wherein the Young's modulus of the material of the vibration plate is different from the Young's modulus of the material of the protective layer.

9. The ink jet head of claim 8, wherein the vibration plate is comprised of an insulating material.

10. The ink jet head of claim 1, wherein the protective layer is comprised of a resin material.

11. The ink jet head of claim 1, wherein the protective layer is comprised of a polyimide layer.

12. The ink jet head of claim 1, wherein the protective layer is comprised of a photosensitive polyimide layer.

* * * * *